US012459618B2

(12) United States Patent
Bailey et al.

(10) Patent No.: US 12,459,618 B2
(45) Date of Patent: Nov. 4, 2025

(54) DEVICE FOR STEERING A TROLLING MOTOR AND METHOD OF THE SAME

(71) Applicant: NAVICO, INC., Tulsa, OK (US)

(72) Inventors: Paul Robert Bailey, Auckland (NZ); Antony Michael Mackenzie, Auckland (NZ)

(73) Assignee: Navico, Inc., Tulsa, OK (US)

( * ) Notice: Subject to any disclaimer, the term of this patent is extended or adjusted under 35 U.S.C. 154(b) by 864 days.

(21) Appl. No.: 17/558,735

(22) Filed: Dec. 22, 2021

(65) Prior Publication Data

US 2023/0192258 A1 Jun. 22, 2023

(51) Int. Cl.

| | |
|---|---|
| ***B63H 20/00*** | (2006.01) |
| ***B63H 20/12*** | (2006.01) |
| ***B63H 25/02*** | (2006.01) |

(52) U.S. Cl.

CPC ..... *B63H 20/007* (2013.01); *B63H 20/12* (2013.01); *B63H 25/02* (2013.01); *B63H 2025/026* (2013.01); *B63H 2025/028* (2013.01)

(58) Field of Classification Search

CPC ..... B63H 20/007; B63H 20/12; B63H 25/02; B63H 2025/026; B63H 2025/028

See application file for complete search history.

(56) References Cited

U.S. PATENT DOCUMENTS

| | | | |
|---|---|---|---|
| 4,737,940 | A | 4/1988 | Arringotn |
| 4,995,010 | A | 2/1991 | Knight |
| 5,525,081 | A | 6/1996 | Mardesich et al. |
| 5,807,150 | A | 9/1998 | Minter, Sr. |
| 6,054,831 | A | 4/2000 | Moore et al. |
| 6,254,441 | B1 | 7/2001 | Knight et al. |
| 6,325,685 | B1 | 12/2001 | Knight et al. |
| 6,369,542 | B1 | 4/2002 | Knight |
| D461,480 | S | 8/2002 | Knight et al. |
| 6,447,347 | B1 | 9/2002 | Steinhauser |
| 6,507,164 | B1 | 1/2003 | Healey et al. |

(Continued)

FOREIGN PATENT DOCUMENTS

| | | | |
|---|---|---|---|
| AU | 2014224154 | B2 | 4/2015 |
| AU | 2021107112 | A4 | 12/2021 |

(Continued)

*Primary Examiner* — Andrew Polay

(74) *Attorney, Agent, or Firm* — Nelson Mullins Riley & Scarborough LLP

(57) ABSTRACT

A device for steering a trolling motor of a watercraft is provided. The device comprises a housing and a joystick attached to the housing, pivotably supported for movement from a neutral position in directions radial to an axis of the joystick. The movement from the neutral position generates a steering command for the trolling motor. The device has a transmitter within the housing and a processor communicatively coupled to the transmitter and the joystick. The device may further include a memory including a computer program code. The computer program code is configured when executed by the processor to receive movement data from the joystick, generate a steering command from the movement data, and transmit the steering command to the trolling motor. The steering command causes the trolling motor to rotate to aim in the steer direction to cause the watercraft to travel based on the joystick movement.

21 Claims, 14 Drawing Sheets

(56) References Cited

U.S. PATENT DOCUMENTS 6,511,354 B1 1/2003 Gonring et al.
6,524,144 B2 2/2003 Pasley
6,620,006 B2 9/2003 Suganuma et al.
6,652,331 B2 11/2003 Healey
6,661,742 B2 12/2003 Hansen
6,678,589 B2 1/2004 Robertson et al.
6,870,794 B2 3/2005 Healey
6,902,446 B1 6/2005 Healey
6,919,704 B1 7/2005 Healey
6,995,527 B2 2/2006 DePasqua
7,004,804 B2 2/2006 Bernloehr et al.
7,048,600 B1 5/2006 Broussard
7,127,333 B2 10/2006 Arvidsson
7,150,662 B1 12/2006 Janitz
7,195,526 B2 3/2007 Bernloehr et al.
7,268,703 B1 9/2007 Kabel et al.
7,303,595 B1 12/2007 Janitz
7,538,511 B2 5/2009 Samek
D594,034 S 6/2009 Bernloehr et al.
7,722,417 B2 5/2010 Bernloehr et al.
7,972,188 B2 7/2011 Bernloehr et al.
8,082,100 B2 12/2011 Grace et al.
8,106,617 B1 1/2012 Holley
8,296,001 B1 10/2012 Kabel et al.
8,305,844 B2 11/2012 DePasqua
8,313,379 B2 11/2012 Ikeda et al.
8,326,472 B2 12/2012 Igarashi et al.
8,510,028 B2 8/2013 Grace et al.
8,515,660 B2 8/2013 Grace et al.
8,515,661 B2 8/2013 Grace et al.
8,523,620 B2 9/2013 Hopkins
8,527,192 B2 9/2013 Grace et al.
8,543,269 B1 9/2013 Wood et al.
8,543,324 B2 9/2013 Grace et al.
8,641,525 B2 2/2014 Burgess et al.
8,645,012 B2 2/2014 Salmon et al.
8,684,328 B2 4/2014 Mynster
8,761,976 B2 6/2014 Salmon
8,798,847 B2 8/2014 Isaac
8,814,129 B2 8/2014 Todd et al.
8,831,868 B2 9/2014 Grace et al.
8,879,359 B2 11/2014 DePasqua
8,888,065 B2 11/2014 Logan
8,894,453 B2 11/2014 Case
8,926,382 B2 1/2015 Van Der et al.
8,936,498 B1 1/2015 Lee
8,974,260 B1 3/2015 Davidson
9,043,073 B2 5/2015 Ricci
9,086,278 B2 7/2015 Carnevali
9,127,707 B1 9/2015 Huntley
9,132,900 B2 9/2015 Salmon et al.
9,160,210 B2 10/2015 Perry
9,162,743 B1 10/2015 Grace et al.
9,260,173 B2 2/2016 Case
9,266,589 B2 2/2016 Grace et al.
9,278,745 B2 3/2016 Kooi, Jr. et al.
9,290,256 B1 3/2016 Wireman et al.
9,296,455 B2 3/2016 Bernloehr et al.
9,394,040 B2 7/2016 Grace et al.
9,405,445 B2 8/2016 Carnevali
9,409,637 B1 8/2016 Arditi
9,415,849 B2 8/2016 Jobs et al.
9,423,259 B2 8/2016 Kabel et al.
9,440,716 B1 9/2016 Arditi
9,446,831 B2 9/2016 Grace et al.
9,459,350 B2 10/2016 Betts et al.
9,463,860 B2 10/2016 Grace et al.
9,505,477 B2 11/2016 Grace et al.
9,522,721 B2 12/2016 Grace et al.
9,569,954 B2 2/2017 Ganz et al.
9,598,157 B2 3/2017 Arditi
9,623,946 B2 4/2017 Delise, Sr.
9,676,462 B2 6/2017 Bernloehr et al.
9,682,759 B1 6/2017 Huntley
9,708,042 B2 7/2017 Grace et al.
9,731,800 B2 8/2017 Arditi
9,738,358 B2 8/2017 Arditi
9,738,364 B2 8/2017 Abney
9,758,222 B2 9/2017 Grace et al.
9,764,808 B2 9/2017 Arditi
9,834,295 B2 12/2017 Cooper et al.
9,878,766 B2 1/2018 Woodruff
9,878,769 B2 1/2018 Kinoshita et al.
9,909,891 B2 3/2018 Langford-Wood
9,937,985 B2 4/2018 Arditi
9,944,365 B2 4/2018 Grace et al.
9,944,375 B1 4/2018 Martin et al.
9,963,214 B2 5/2018 Watanabe et al.
9,988,134 B1 6/2018 Gable et al.
10,000,268 B1 6/2018 Poirier et al.
10,082,788 B1 * 9/2018 Dengel ..... B63H 25/02
10,107,908 B2 10/2018 Betts et al.
10,137,972 B2 11/2018 Kawasaki et al.
10,150,551 B2 12/2018 Steward et al.
10,179,633 B2 1/2019 Carnevali
10,266,242 B2 4/2019 Arditi
10,281,576 B2 5/2019 DePasqua
10,281,928 B2 5/2019 Behling et al.
10,290,124 B2 5/2019 Steward
10,295,999 B2 5/2019 Jobs et al.
10,322,780 B2 6/2019 Grace et al.
10,351,218 B2 7/2019 Arditi
10,370,076 B2 8/2019 Wireman
10,377,458 B1 8/2019 Mcginley
10,460,484 B2 10/2019 Hovland et al.
10,464,649 B1 11/2019 Wood
10,464,653 B2 11/2019 Anderson et al.
10,488,204 B2 11/2019 Rivers
10,507,895 B2 12/2019 Grace et al.
10,526,060 B2 1/2020 Arditi
10,618,621 B1 4/2020 Rott et al.
10,633,072 B1 4/2020 Arbuckle et al.
10,723,423 B2 7/2020 Eyal et al.
10,745,096 B2 8/2020 Clark
10,766,589 B1 9/2020 Ito
10,775,177 B2 9/2020 Rivers
10,809,725 B2 10/2020 Combs
10,845,812 B2 11/2020 Ward et al.
D905,757 S 12/2020 Domke et al.
10,913,524 B1 2/2021 Wald et al.
10,921,802 B2 2/2021 Bertrand et al.
10,926,855 B2 2/2021 Derginer et al.
10,953,973 B2 3/2021 Hayashi et al.
10,981,634 B2 4/2021 Arditi
11,059,555 B2 7/2021 Ahlgren
11,059,556 B2 7/2021 Ahlgren
11,072,402 B2 7/2021 Arditi
11,104,409 B2 8/2021 Pietola et al.
11,104,410 B2 8/2021 Kester et al.
11,173,996 B2 11/2021 Salmon et al.
11,367,425 B2 6/2022 Antao et al.
2001/0020603 A1 9/2001 Moorehead et al.
2002/0044500 A1 4/2002 Hansen
2003/0191562 A1 10/2003 Robertson et al.
2003/0203684 A1 10/2003 Healey
2005/0255761 A1 11/2005 Bernloehr et al.
2006/0089794 A1 4/2006 DePasqua
2006/0116031 A1 6/2006 Bernloehr et al.
2009/0037040 A1 2/2009 Salmon et al.
2009/0043436 A1 2/2009 Igarashi et al.
2009/0163090 A1 6/2009 Heromin
2009/0227158 A1 9/2009 Bernloehr et al.
2010/0116967 A1 5/2010 Todd et al.
2012/0014220 A1 1/2012 DePasqua
2012/0015566 A1 1/2012 Salmon
2012/0204467 A1 8/2012 Palmer et al.
2012/0232719 A1 9/2012 Salmon et al.
2013/0044569 A1 2/2013 DePasqua
2013/0110329 A1 5/2013 Kinoshita et al.
2013/0215719 A1 8/2013 Betts et al.
2014/0203162 A1 7/2014 Logan
2014/0249698 A1 9/2014 Salmon et al.
2014/0269164 A1 9/2014 Betts et al.
2014/0277851 A1 9/2014 Grace et al.

(56) References Cited

U.S. PATENT DOCUMENTS

| | | | | |
|---|---|---|---|---|
| 2015/0016130 | A1 | 1/2015 | Davis et al. | |
| 2015/0063059 | A1 | 3/2015 | DePasqua | |
| 2015/0063060 | A1 | 3/2015 | DePasqua | |
| 2015/0346729 | A1 | 12/2015 | Grace et al. | |
| 2015/0346730 | A1 | 12/2015 | Stephens et al. | |
| 2016/0016651 | A1 | 1/2016 | Anderson et al. | |
| 2017/0158297 | A1 | 6/2017 | Sampson | |
| 2017/0160738 | A1 | 6/2017 | Ganz et al. | |
| 2018/0129213 | A1 | 5/2018 | Pelin et al. | |
| 2019/0138014 | A1 | 5/2019 | Väänänen et al. | |
| 2019/0138015 | A1 | 5/2019 | Pietola et al. | |
| 2019/0154450 | A1 | 5/2019 | Wada | |
| 2019/0219692 | A1 | 7/2019 | DePasqua | |
| 2020/0017177 | A1 | 1/2020 | Eyal et al. | |
| 2020/0018601 | A1 | 1/2020 | Yamabayashi et al. | |
| 2020/0049507 | A1 | 2/2020 | Clark et al. | |
| 2020/0062365 | A1 | 2/2020 | Anderson et al. | |
| 2020/0269962 | A1 | 8/2020 | Gai et al. | |
| 2020/0272152 | A1* | 8/2020 | Combs | G05D 1/0206 |
| 2020/0398963 | A1 | 12/2020 | Miyashita | |
| 2021/0009239 | A1 | 1/2021 | Eyal et al. | |
| 2021/0139126 | A1 | 5/2021 | Derginer et al. | |
| 2021/0163114 | A1 | 6/2021 | Bondesson et al. | |
| 2021/0229781 | A1 | 7/2021 | Arditi | |
| 2021/0291951 | A1* | 9/2021 | Gai | G05G 9/047 |
| 2021/0371074 | A1 | 12/2021 | Lammers-Meis | |
| 2022/0009604 | A1 | 1/2022 | Arditi | |
| 2022/0017203 | A1 | 1/2022 | Pedersen | |
| 2022/0063772 | A1 | 3/2022 | Ambler | |
| 2022/0073180 | A1 | 3/2022 | Salmon et al. | |
| 2022/0212770 | A1 | 7/2022 | Cosentino et al. | |
| 2022/0234702 | A1 | 7/2022 | Maddox et al. | |
| 2023/0139789 | A1* | 5/2023 | Ikegaya | B63H 21/21 440/1 |

FOREIGN PATENT DOCUMENTS

| | | | | |
|---|---|---|---|---|
| CA | 2359223 | C | 10/2006 | |
| CA | 2962361 | A1 | 4/2015 | |
| CA | 2891245 | A1 | 12/2015 | |
| CA | 2897182 | A1 | 1/2016 | |
| CA | 2897540 | A1 | 1/2016 | |
| CA | 2641186 | C | 5/2017 | |
| CA | 2895863 | C | 10/2017 | |
| CA | 2952593 | C | 6/2018 | |
| CA | 3108305 | A1 | 2/2020 | |
| CA | 2982936 | C | 11/2020 | |
| CN | 207956019 | U | 10/2018 | |
| CN | 213892861 | U | 8/2021 | |
| CN | 114842635 | A | 8/2022 | |
| EP | 0024813 | B1 | 5/1983 | |
| EP | 1448436 | B1 | 4/2010 | |
| EP | 2586696 | A1 | 5/2013 | |
| EP | 1891461 | B1 | 5/2014 | |
| EP | 2952994 | A1 | 12/2015 | |
| EP | 3176068 | B1 | 6/2017 | |
| EP | 2974242 | B1 | 7/2018 | |
| EP | 3406516 | B1 | 9/2019 | |
| EP | 3594621 | A1 | 1/2020 | |
| EP | 3604110 | A1 | 2/2020 | |
| EP | 3633318 | A1 | 4/2020 | |
| EP | 3653489 | A1 | 5/2020 | |
| EP | 3283364 | B1 | 7/2020 | |
| EP | 3699714 | A2 | 8/2020 | |
| EP | 3707072 | A1 | 9/2020 | |
| EP | 3716015 | A1 | 9/2020 | |
| EP | 3728021 | A1 | 10/2020 | |
| EP | 3821419 | A1 | 5/2021 | |
| EP | 3830806 | A1 | 6/2021 | |
| EP | 3914983 | A1 | 12/2021 | |
| EP | 4034460 | A1 | 8/2022 | |
| EP | 4045394 | A1 | 8/2022 | |
| JP | 2002-154483 | A | 5/2002 | |
| JP | 4706032 | B2 | 6/2011 | |
| JP | 4709975 | B2 | 6/2011 | |
| JP | 2013103526 | A | 5/2013 | |
| JP | 2013106082 | A | 5/2013 | |
| JP | 5827872 | B2 | 12/2015 | |
| JP | 5836765 | B2 | 12/2015 | |
| JP | 2018-99902 | A | 6/2018 | |
| JP | 2018-125012 | A | 8/2018 | |
| JP | 6372046 | B2 | 8/2018 | |
| JP | 6513677 | B2 | 5/2019 | |
| JP | 6769611 | B2 | 10/2020 | |
| JP | 2021-501724 | A | 1/2021 | |
| WO | WO 1995/028682 | A1 | 10/1995 | |
| WO | WO 03/042036 | A1 | 5/2003 | |
| WO | WO-2006062416 | A1 * | 6/2006 | B63H 25/46 |
| WO | WO 2006/112416 | A1 | 10/2006 | |
| WO | WO 2013/126761 | A1 | 8/2013 | |
| WO | WO 2014/052531 | A1 | 4/2014 | |
| WO | WO 2014/144471 | A1 | 9/2014 | |
| WO | WO 2014/152628 | A1 | 9/2014 | |
| WO | WO 2015/048479 | A1 | 4/2015 | |
| WO | WO 2016/017358 | A1 | 2/2016 | |
| WO | WO 2016/168025 | A1 | 10/2016 | |
| WO | WO 2017/146796 | A1 | 8/2017 | |
| WO | WO 2019/082044 | A1 | 5/2019 | |
| WO | WO 2019/086762 | A1 | 5/2019 | |
| WO | WO 2019/125177 | A1 | 6/2019 | |
| WO | WO 2020/007471 | A1 | 1/2020 | |
| WO | WO 2020/016881 | A1 | 1/2020 | |
| WO | WO 2020/069750 | A1 | 4/2020 | |
| WO | WO 2020/070312 | A1 | 4/2020 | |
| WO | WO 2020/098898 | A1 | 5/2020 | |
| WO | WO 2020/193756 | A1 | 10/2020 | |
| WO | WO 2021/061612 | A1 | 4/2021 | |
| WO | WO 2021/074483 | A1 | 4/2021 | |
| WO | WO 2021/173441 | A1 | 9/2021 | |
| WO | WO 2022/159867 | A1 | 7/2022 | |

* cited by examiner

DEVICE FOR STEERING A TROLLING MOTOR AND METHOD OF THE SAME

FIELD OF THE INVENTION

Embodiments of the present invention relate generally to trolling motor steering, and more particularly, to steering a trolling motor with a remote handheld device.

BACKGROUND OF THE INVENTION

Trolling motor assemblies are often used during fishing or other marine activities. The trolling motor system attaches to the watercraft and propels the watercraft along a body of water. While trolling motor assemblies may be utilized as the main propulsion system of watercraft, trolling motor assemblies are often utilized to provide secondary propulsion or precision maneuvering that can be ideal for fishing activities. Typically, trolling motor assemblies include a small gas or electric trolling motor for providing thrust and a steering mechanism for changing the direction of the generated thrust.

BRIEF SUMMARY OF THE INVENTION

Handheld remote controls generally use a push pad to indicate the desired direction of rotation of a trolling motor. In some devices, when a user engages a button the trolling motor will rotate a specific amount in that direction, for example, pressing the right button may cause a trolling motor to rotate to the right by 1 degree, 5 degrees or 10 degrees. However, the user is generally unable to easily determine (e.g., with a quick look) the orientation of the trolling motor with respect to the heading of the watercraft. Therefore, the user must make multiple adjustments to determine the orientation of the trolling motor and rotate the trolling motor to the desired orientation. Further, steering the trolling motor to a desired direction requires a user determination of which way to rotate the trolling motor and then having to continually hold down the appropriate push pad and releasing it at the exact correct time (e.g., to avoid overshoot). This process can be frustrating to a user.

Alternatively, a user may use a foot pedal to steer the trolling motor. The foot pedal may provide an electrical signal based on the foot pedal's position to electronically steer the trolling motor wherein tilting the back of the foot pedal downward leads to trolling motor to rotate to the left, and tilting the front of the foot pedal downward leads the trolling motor to rotate to the right. However, the foot pedal may include similar limitations to the remote, wherein a user is unable to readily determine the orientation of the trolling motor at a given time. Further, steering the trolling motor to a desired direction requires a user determination of which way to rotate the trolling motor and then having to continually hold down the foot pedal in the proper direction and releasing it at the exact correct time (e.g., to avoid overshoot). This process can be frustrating to a user.

Applicant has developed various systems and methods, as detailed herein to provide a device to steer a trolling motor to a desired orientation with a remote device, without needing to specify a rotation direction and current knowledge of the orientation of the trolling motor.

Some embodiments of the present invention are directed to a device (e.g., a handheld) for use with a trolling motor assembly. The device may be in electrical communication with the trolling motor assembly, such that movement of a joystick from a neutral position causes the trolling motor to rotate directly to a specific direction corresponding to the movement of the joystick. Prior knowledge of the current direction the trolling motor is facing and/or knowing exactly when to stop providing input (such as to not overshoot the direction) is not required for such example embodiments of the invention-providing advantages of prior trolling motor direction steering devices. The device may include various push buttons configured to engage or disengage other features of the trolling motor system, for example, the propeller, a virtual anchor, and/or an autopilot.

In an example embodiment, a handheld device for steering a trolling motor of a watercraft is provided, including a housing and a joystick. The joystick is attached to the housing and pivotably supported for movement from a neutral position in directions radial to an axis of the joystick. The movement of the joystick from the neutral position generates a steering command for the trolling motor. The handheld device further includes a transmitter within the housing, and a processor communicatively coupled to the transmitter and the joystick. The handheld device further includes a memory including a computer program product stored thereon. The computer program product is configured, when executed by the processor, to receive movement data from the joystick including a direction of movement from the neutral position; generate, based on the movement data, the steering command for instructing the trolling motor to aim in a steer direction, wherein the steer direction directly corresponds to the direction of movement from the neutral position; and transmit the steering command to the trolling motor, wherein the steering command causes the trolling motor to rotate so as to aim in the steer direction to cause the watercraft to travel based on the joystick movement.

In some embodiments, the handheld device further comprises a button having an engaged position and a disengaged position attached to the housing opposite the joystick so as to form a trigger. The computer program code is further configured, when executed by the processor to determine that the button is in the engaged position; and generate the steering command if the button is in the engaged position.

In some embodiments the handheld device further comprises a pressure sensor positioned relative to the joystick. The pressure sensor is configured to generate a pressure indication from radial movement of the joystick from the neutral position. The computer program code is further configured, when executed by the processor, to: receive the pressure indication from the pressure sensor; generate, based on the pressure indication, a thrust command for instructing the trolling motor to operate according to a speed, wherein a degree of thrust varies with respect to a degree of pressure applied to the joystick; and transmit the thrust command to the trolling motor.

In some embodiments, the joystick further comprises a joystick button. The joystick button is moveable between a disengaged position and an engaged position. The joystick button is moved to the engaged position by pressing a top face of the joystick into the housing.

In some embodiments, the joystick button, when pressed into the engaged position, generates a virtual anchor signal. The computer program product is further configured, when executed by the processor, to: receive engagement data from the joystick button; generate, based on the engagement data, the virtual anchor signal for instructing the trolling motor to engage in a virtual anchor protocol; and transmit the virtual anchor signal to the trolling motor, instructing the trolling motor to engage the virtual anchor protocol to cause the watercraft to maintain a current position.

In some embodiments, the handheld device further comprises at least one button positioned adjacent the joystick. The at least one button is configured to generate a command when engaged. The computer program product is further configured, when executed by the processor to: receive engagement data from the at least on button; generate, based on the engagement data, the command for instructing the watercraft; and transmit the command to the watercraft. In some embodiments, the command is selected from the group consisting of: engage a propeller; turn on an autopilot; provide input to a user interface; disengage the propeller, and turn off the autopilot.

In some embodiments, the handheld device further comprises a display positioned adjacent the joystick on the housing. In some embodiments, the display is configured to present marine data.

In some embodiments, wherein the computer program product is further configured, when executed by the processor to: receive orientation data from a position sensor, wherein the orientation indicates an orientation of the trolling motor; and determine a path of least rotation between the orientation of the trolling motor and the steer direction. In some embodiments, the steering command indicates the trolling motor to rotate counterclockwise to the steer direction. In some embodiments, the steering command indicates the trolling motor to rotate clockwise to the steer direction.

In some embodiments, the computer program product, is further configured, when executed by the processor to: assign a forward direction to movement of the joystick from the neutral position, wherein the forward direction corresponds to a forward direction of the watercraft; determine an angle of difference between the direction of movement of the joystick and the forward direction; and determine the steer direction based on the angle of difference.

In another embodiment a system for use with a watercraft is provided. The system comprises a trolling motor assembly. The trolling motor assembly comprises a shaft having a first end and a second end defining a shaft axis extending between the first end and the second end. The trolling motor assembly further comprises a trolling motor at least partially contained within a trolling motor housing. The trolling motor housing is attached to the second end of the shaft, when the trolling motor assembly is attached to the watercraft and the trolling motor housing is submerged in a body of water, the trolling motor, when operating, is configured to rotate about the shaft axis and propel the watercraft to travel along the body of water. The trolling motor assembly further comprises a main housing connected to the shaft proximate the first end of the shaft, wherein the main housing is configured to be positioned out of the body of water when the trolling motor assembly is attached to the watercraft and the trolling motor housing is submerged in the body of water.

The system further comprises a user input assembly. The user input assembly comprises a housing, and a joystick attached to the housing pivotably supported for movement from a neutral position in directions radial to an axis of the joystick. The movement from the neutral position generates a steering command for the trolling motor. The user input assembly further comprises a transmitter within the housing communicatively coupled to a controller, a processor communicatively coupled to the transmitter and the joystick; and a memory including a computer program product stored thereon. The computer program product is configured, when executed by the processor, to: receive movement data from the joystick including a direction of movement from the neutral position; generate, based on the movement data, the steering command for instructing the trolling motor to aim in a steer direction, wherein the steer direction directly corresponds to the direction of movement from the neutral position; and transmit the steering command to a controller, wherein the steering command indicates a rotation about the shaft axis so as to aim the trolling motor in the steer direction corresponding to the joystick movement. The controller is configured to cause the trolling motor to rotate about the shaft axis to aim in the steer direction to cause the watercraft to travel based on the joystick movement.

In some embodiments, the user input assembly further comprises a trigger button disposed opposite the joystick. The trigger button is moveable between an engaged position and a disengaged position. The steering command is generated when the trigger button is in the engaged position.

In some embodiments, the joystick further comprises a joystick button. The joystick button is moveable between a disengaged position and an engaged position, the joystick button is moved to the engaged position by pressing a top face of the joystick into the housing.

In some embodiments, a virtual anchor command is generated when the joystick button is engaged. The computer program product is further configured, when executed by the processor, to: receive engagement data from the joystick button; generate, based on the engagement data, the virtual anchor command for instructing the controller to keep the watercraft at a current position; and transmit the virtual anchor command to the controller, wherein the virtual anchor command causes the controller to rotate the trolling motor about the shaft axis to cause the watercraft to maintain the current position.

In some embodiments, the controller is within the main housing of the trolling motor. In some embodiments, the controller is in a remote marine electronic device at a helm of the watercraft.

In yet another embodiment a method of steering a watercraft is provided. The method comprises receiving movement data from a joystick of a user input device. The user input device comprises a housing attached to the joystick. The joystick is pivotably supported for movement from a neutral position in directions radial to an axis of the joystick. The user input device further comprises a transmitter within the housing, and a processor. The method continues by generating, based on the movement data, a steering command for instructing a trolling motor to aim in a steer direction. The steer direction directly corresponds to the direction of movement of the joystick from the neutral position. The method continues by transmitting the steering command to a controller. The controller is communicatively coupled to the trolling motor, and controller causes the trolling motor to execute the steering command. The steering command causes the trolling motor to rotate so as to aim in the steer direction to cause the watercraft to travel based on the joystick movement.

In some embodiments, the method further comprises calibrating the user input device with the trolling motor, such that a forward movement of the joystick corresponds to a forward orientation of the trolling motor, wherein the forward orientation of the trolling motor corresponds with a forward direction of the watercraft.

BRIEF DESCRIPTION OF THE DRAWINGS

Figure 1:
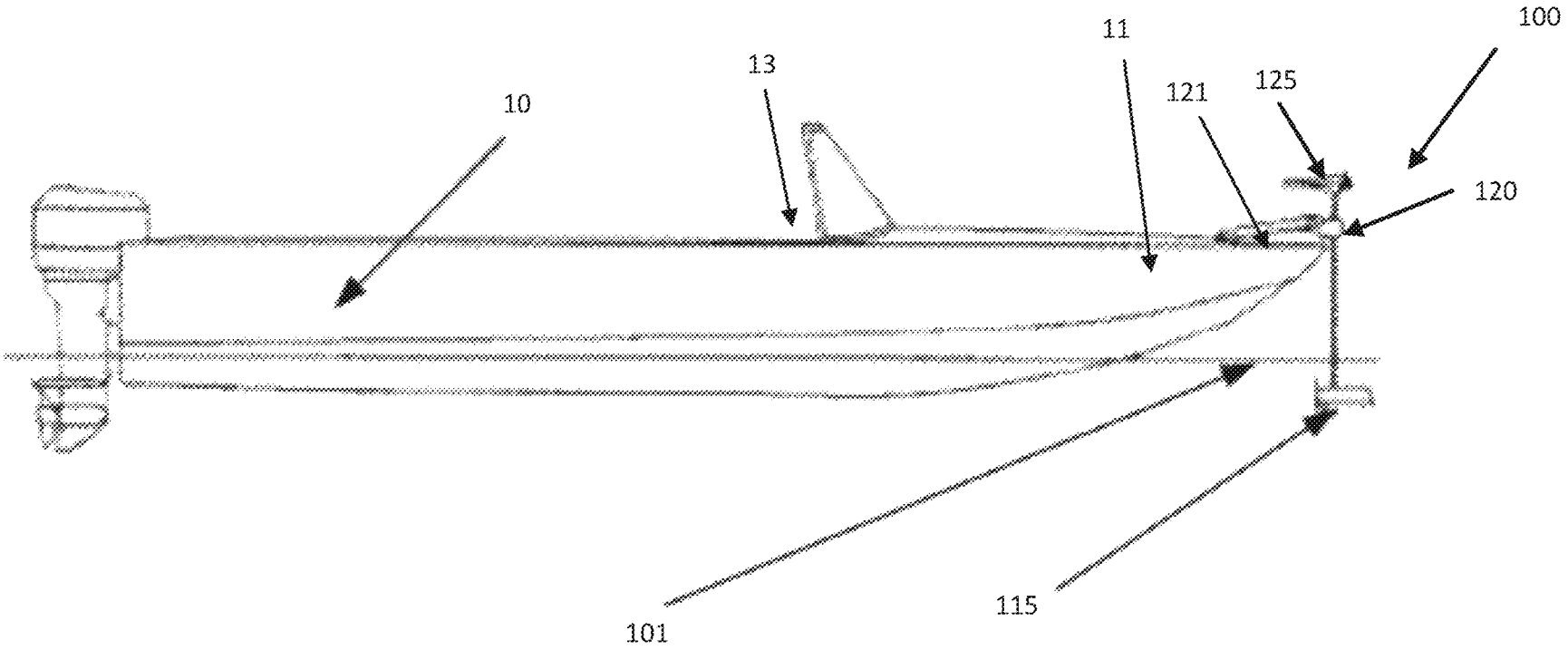
Figure 2:
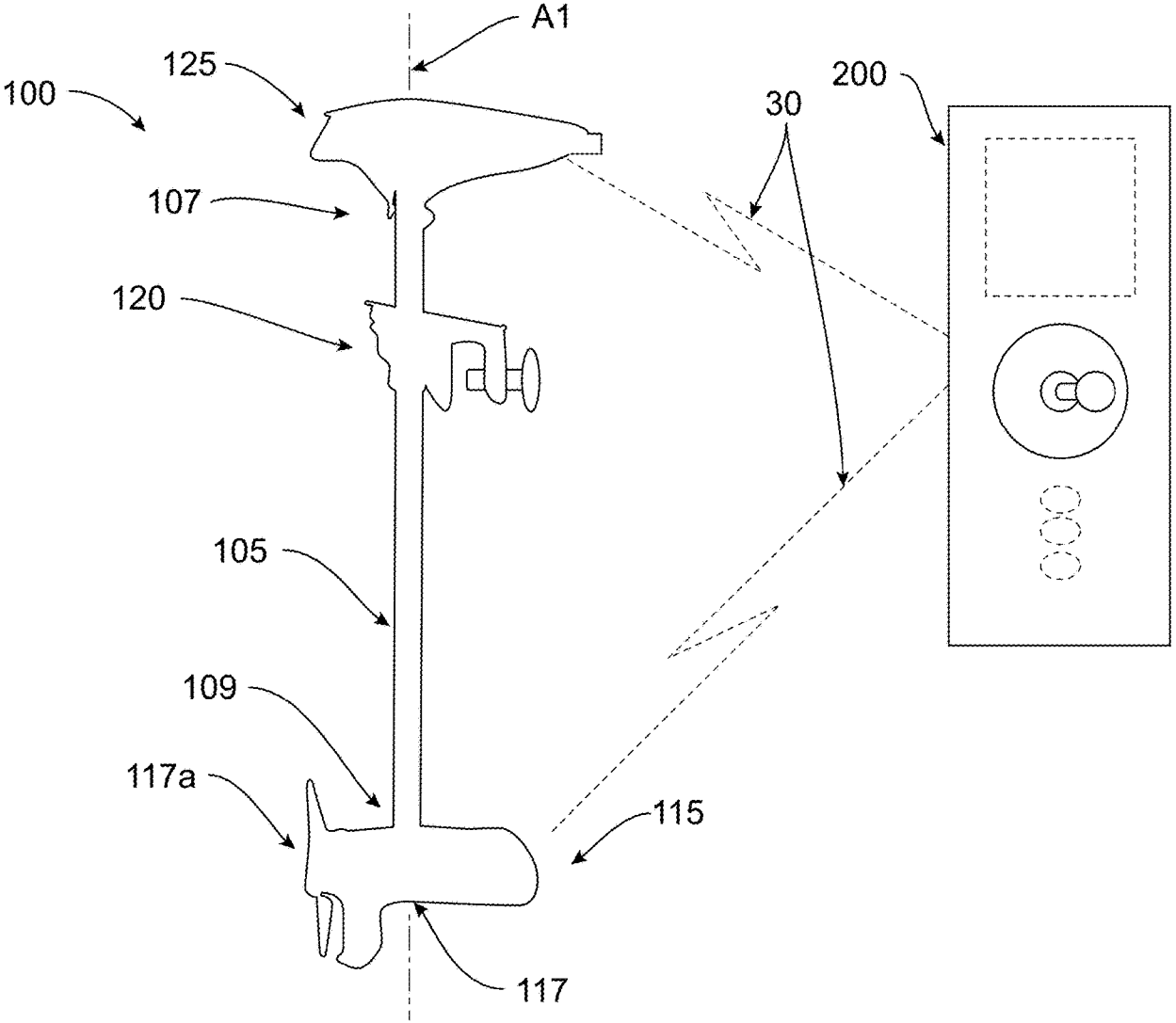
Figure 3A:
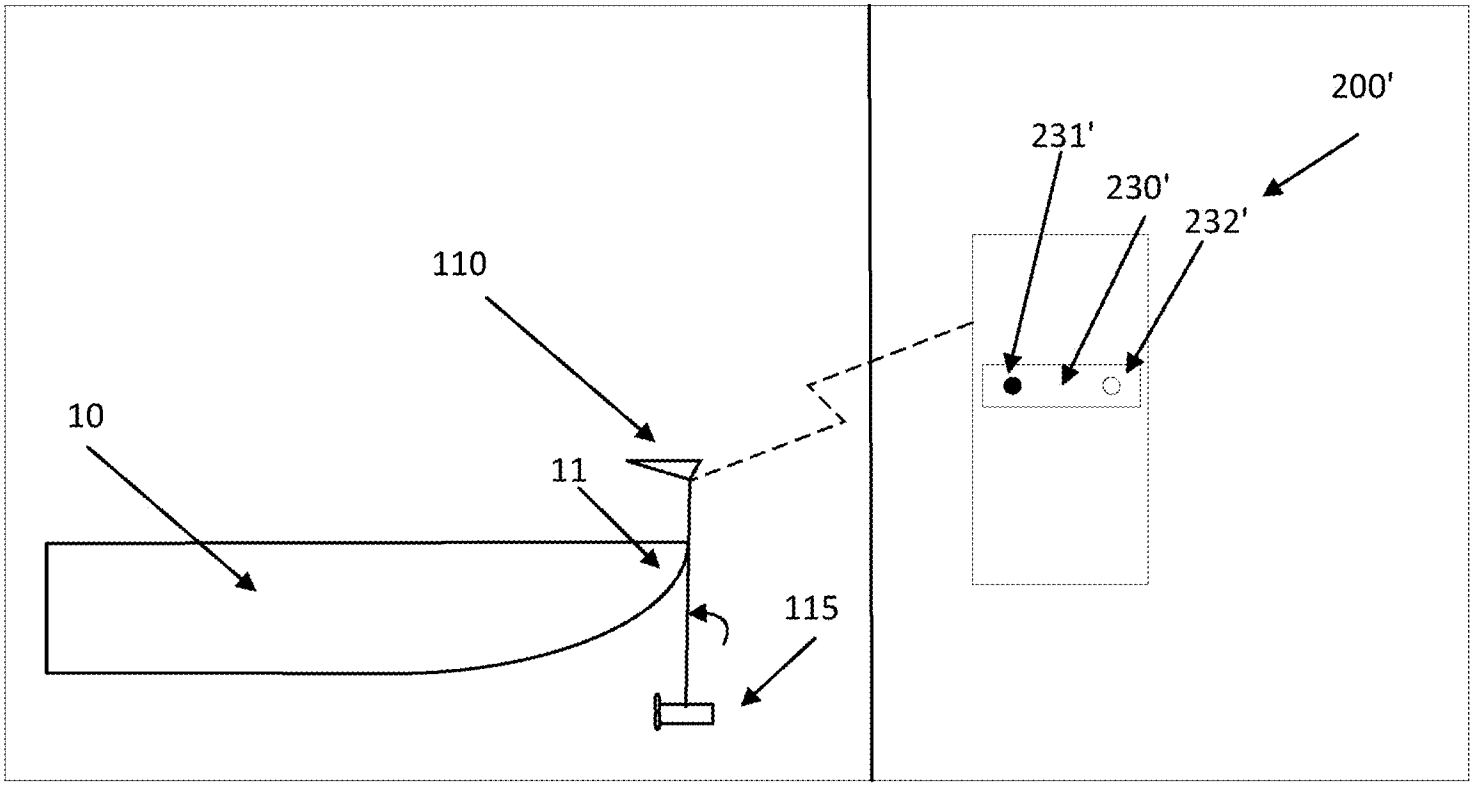
Figure 3B:
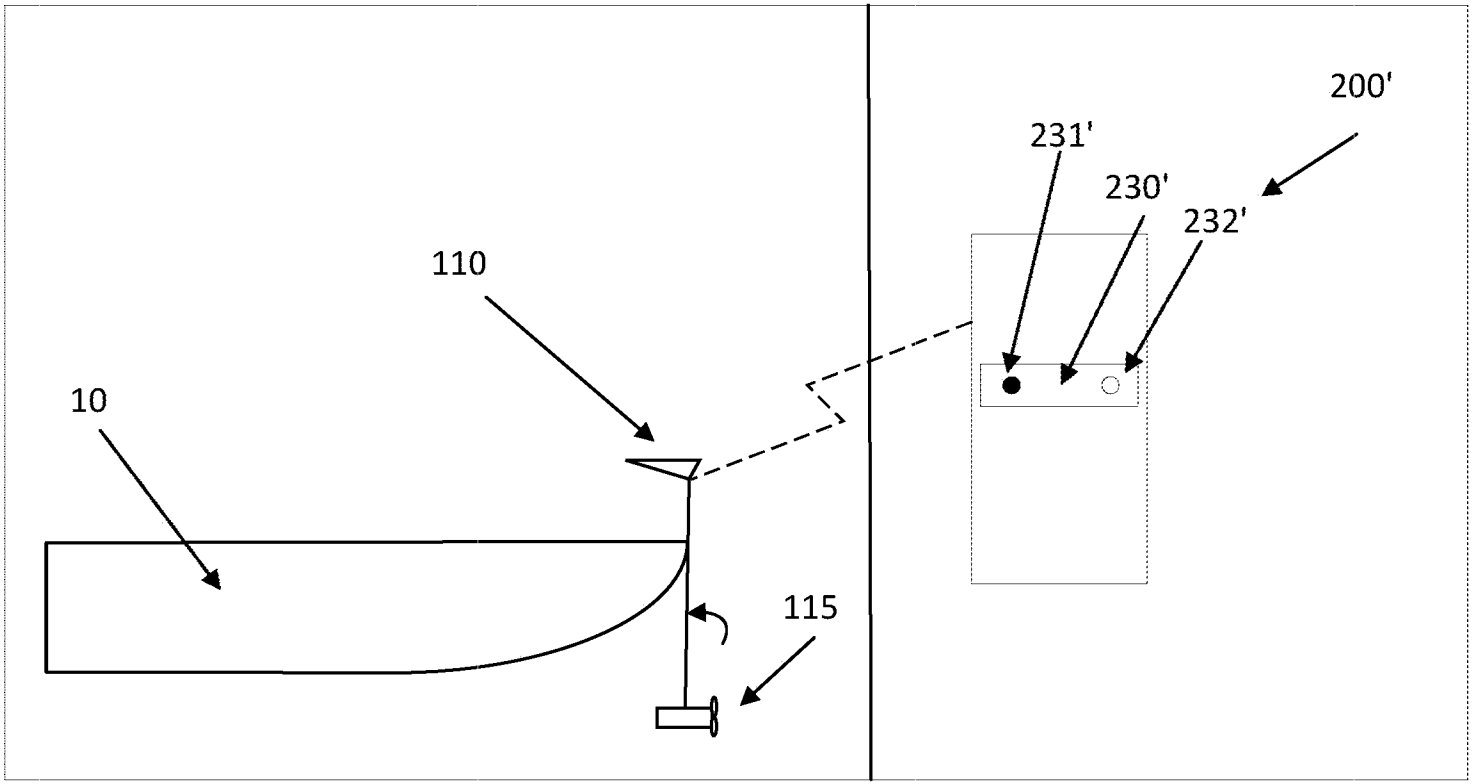
Figure 4B:
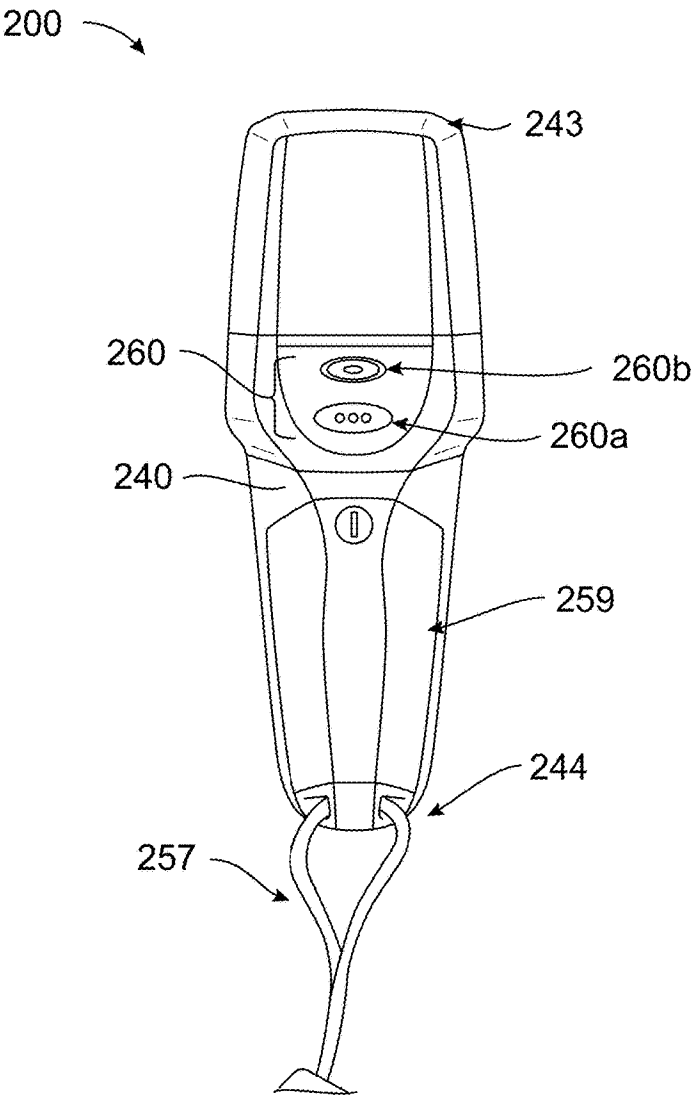
Figure 4A:
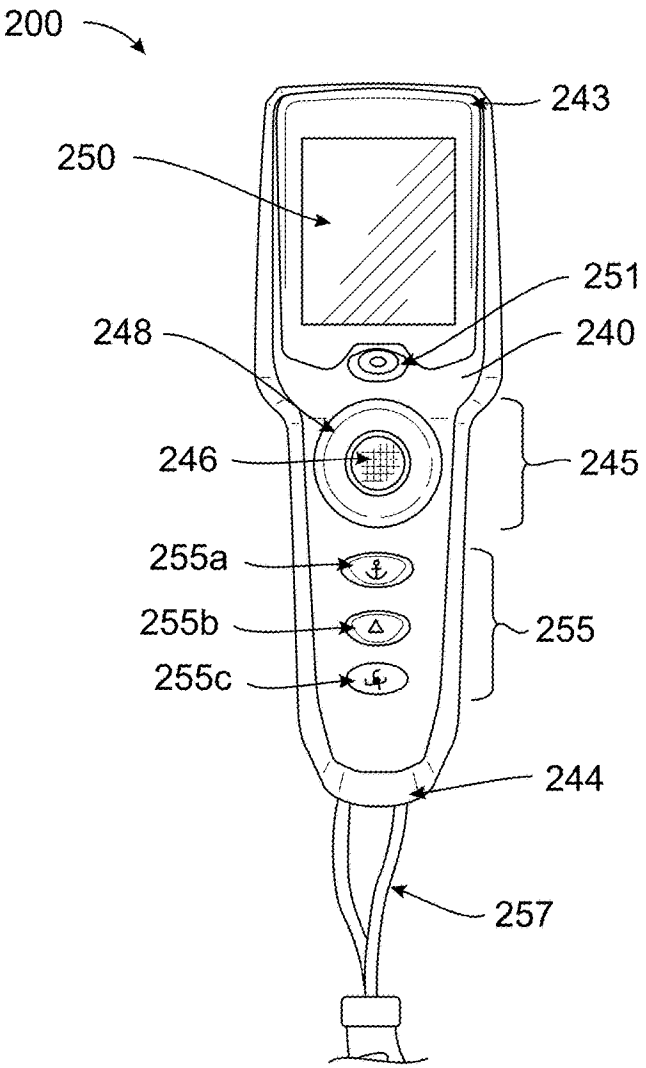
Figure 4C:
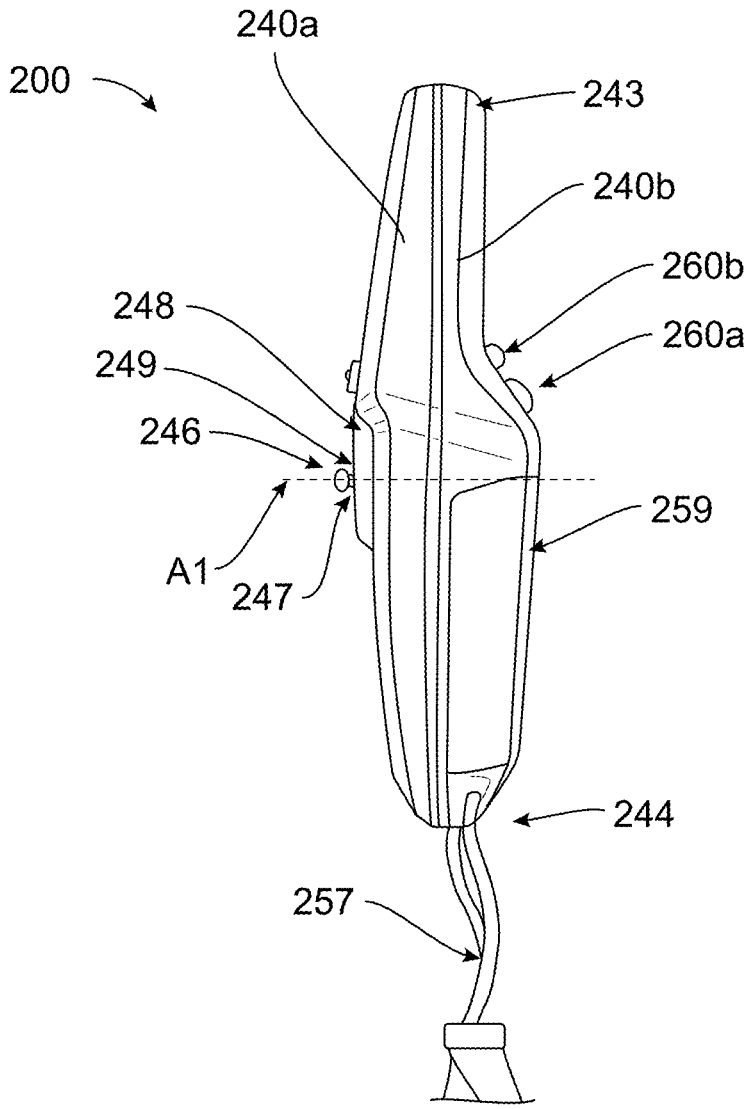
Figure 5B:
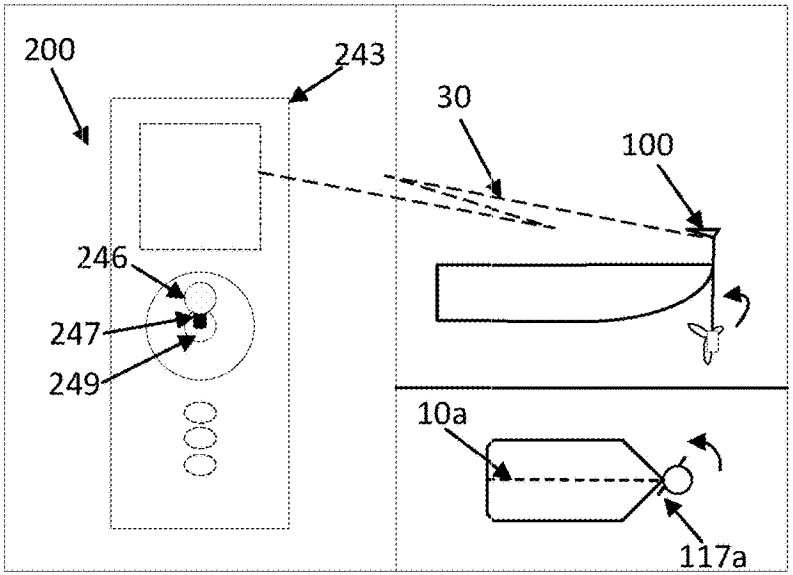
Figure 5A:
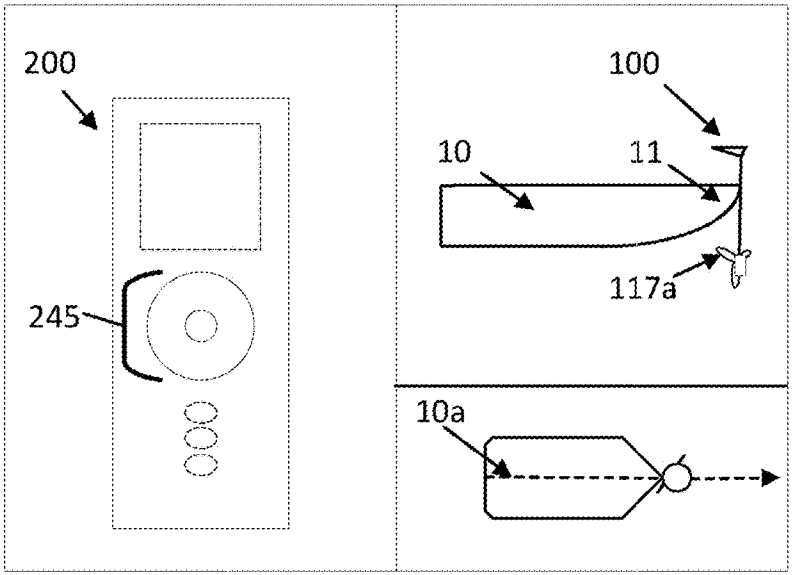
Figure 5C:
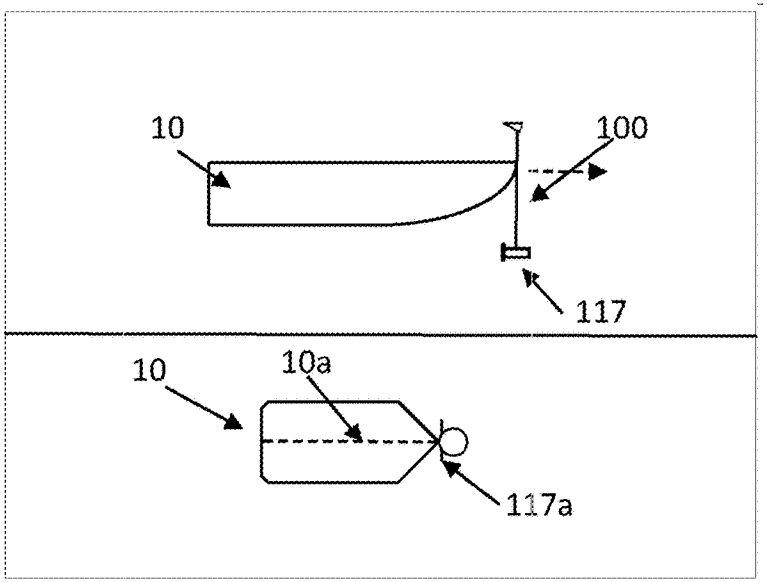
Figure 6B:
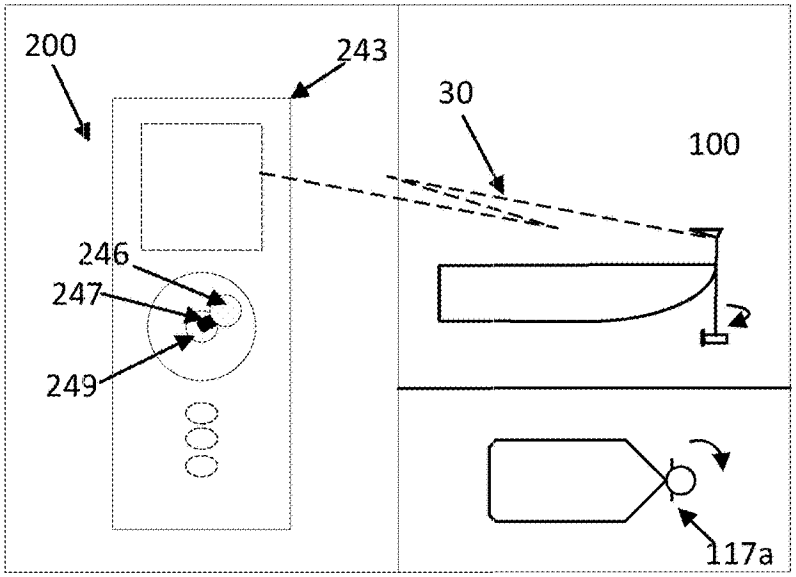
Figure 6A:
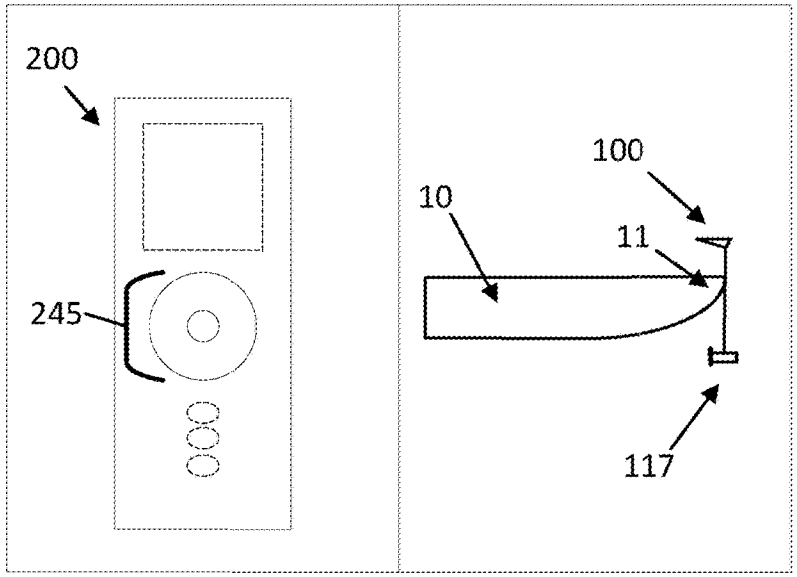
Figure 6C:
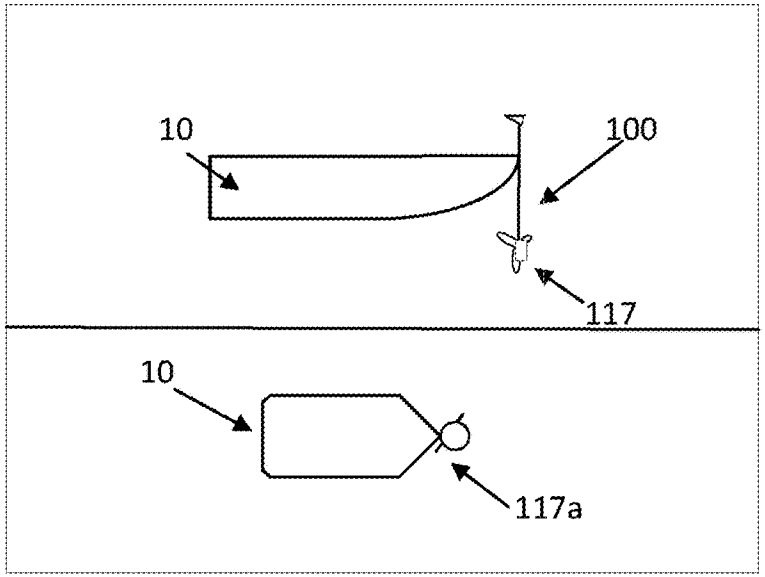
Figure 7B:
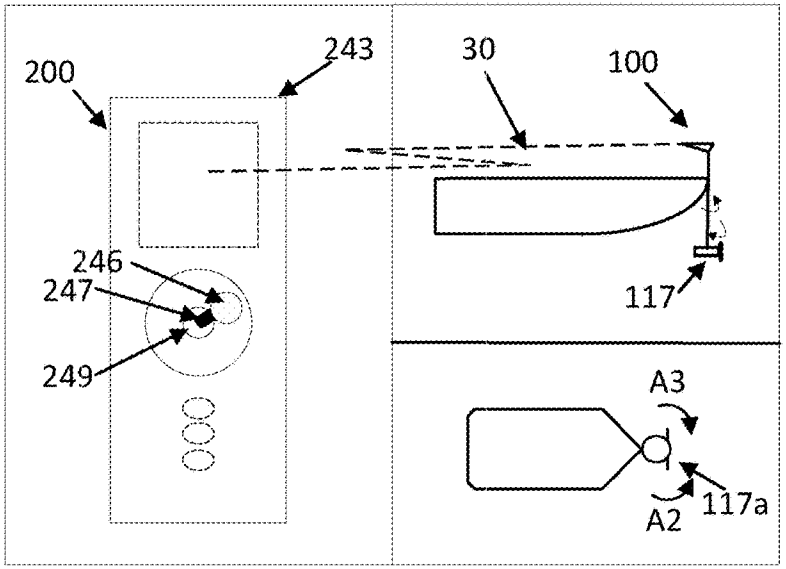
Figure 7A:
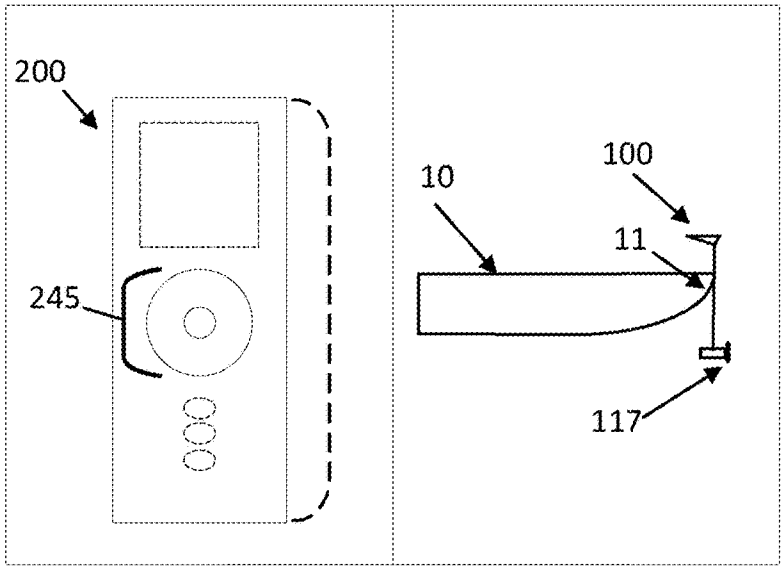
Figure 7C:
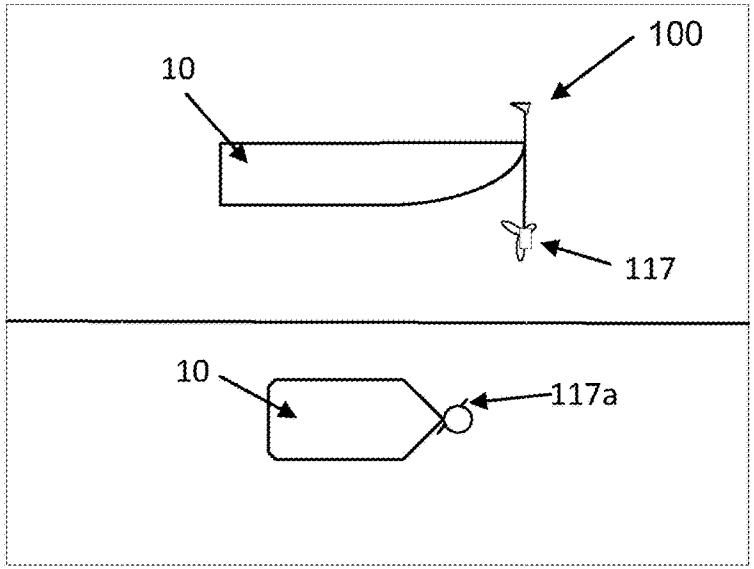
Figure 8A:
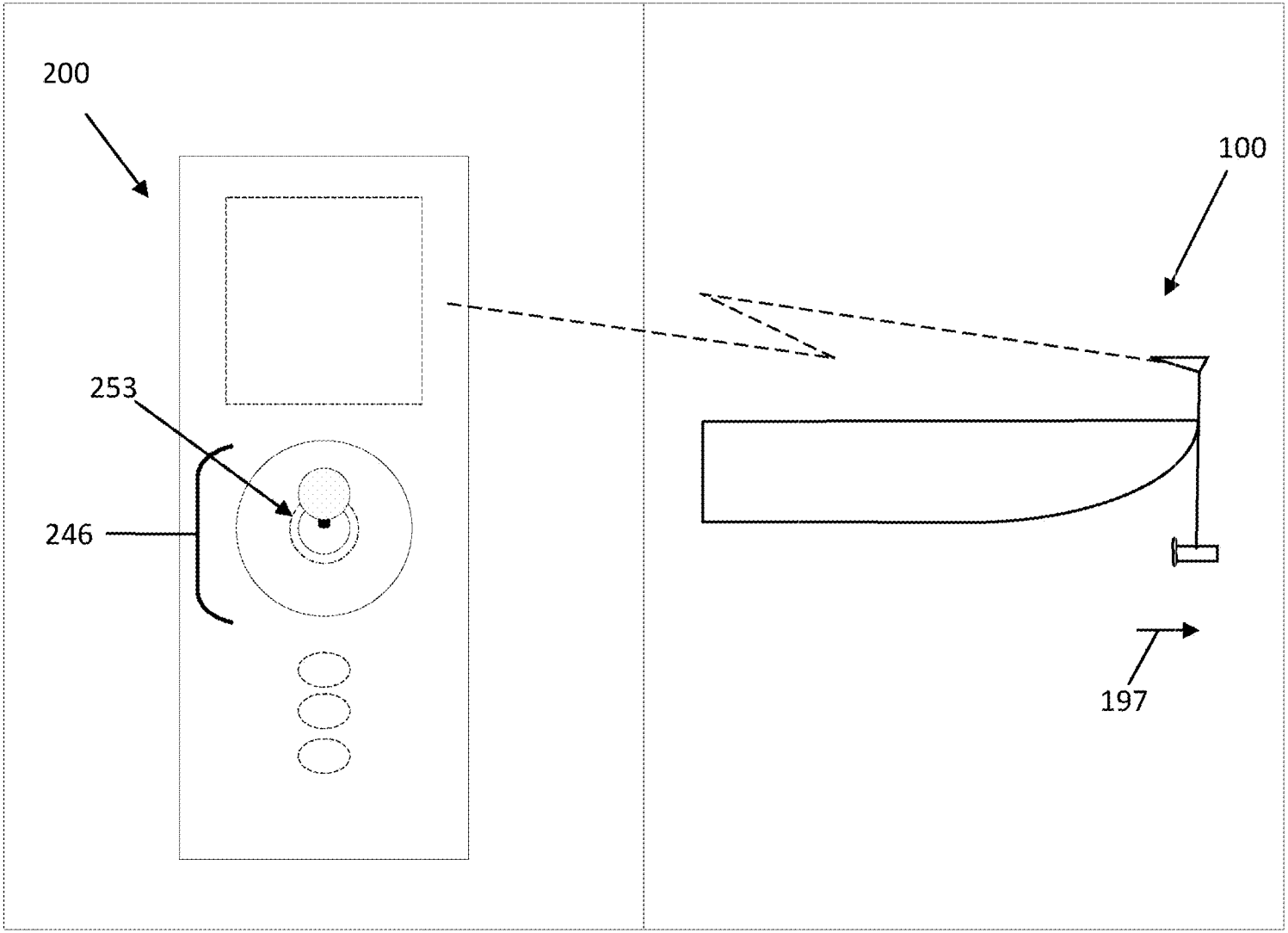
Figure 8B:
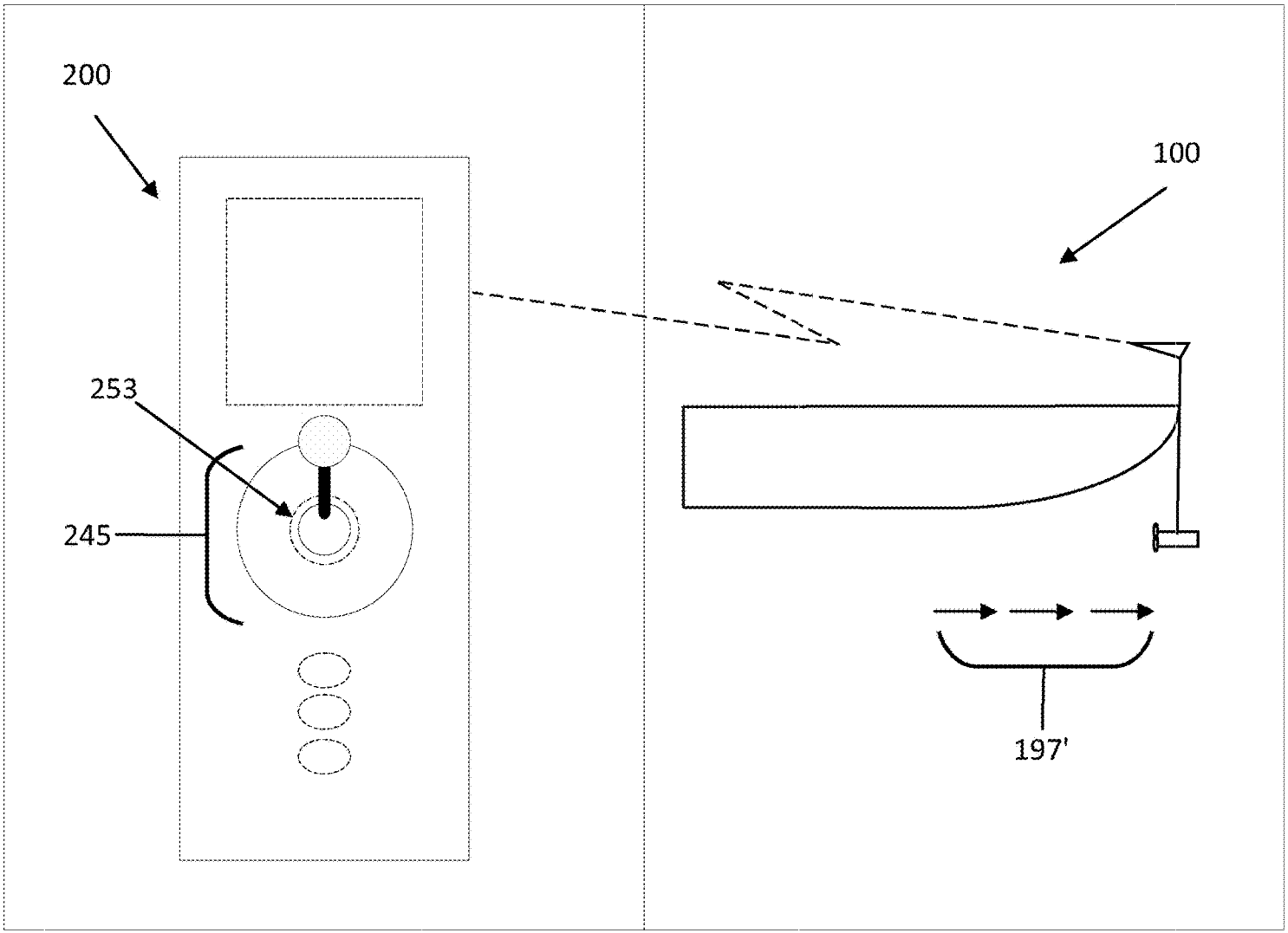
Figure 9:
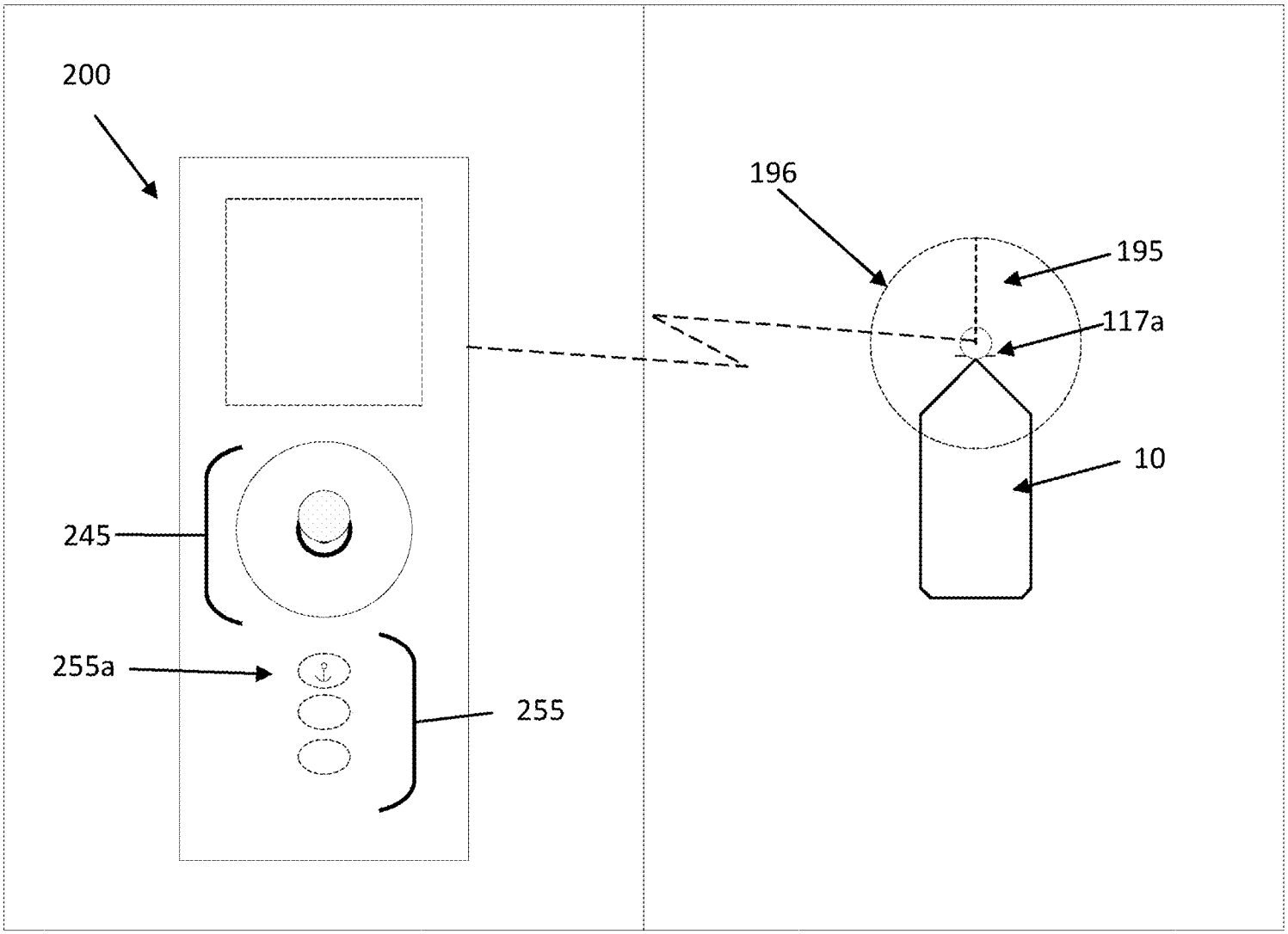
Figure 10:
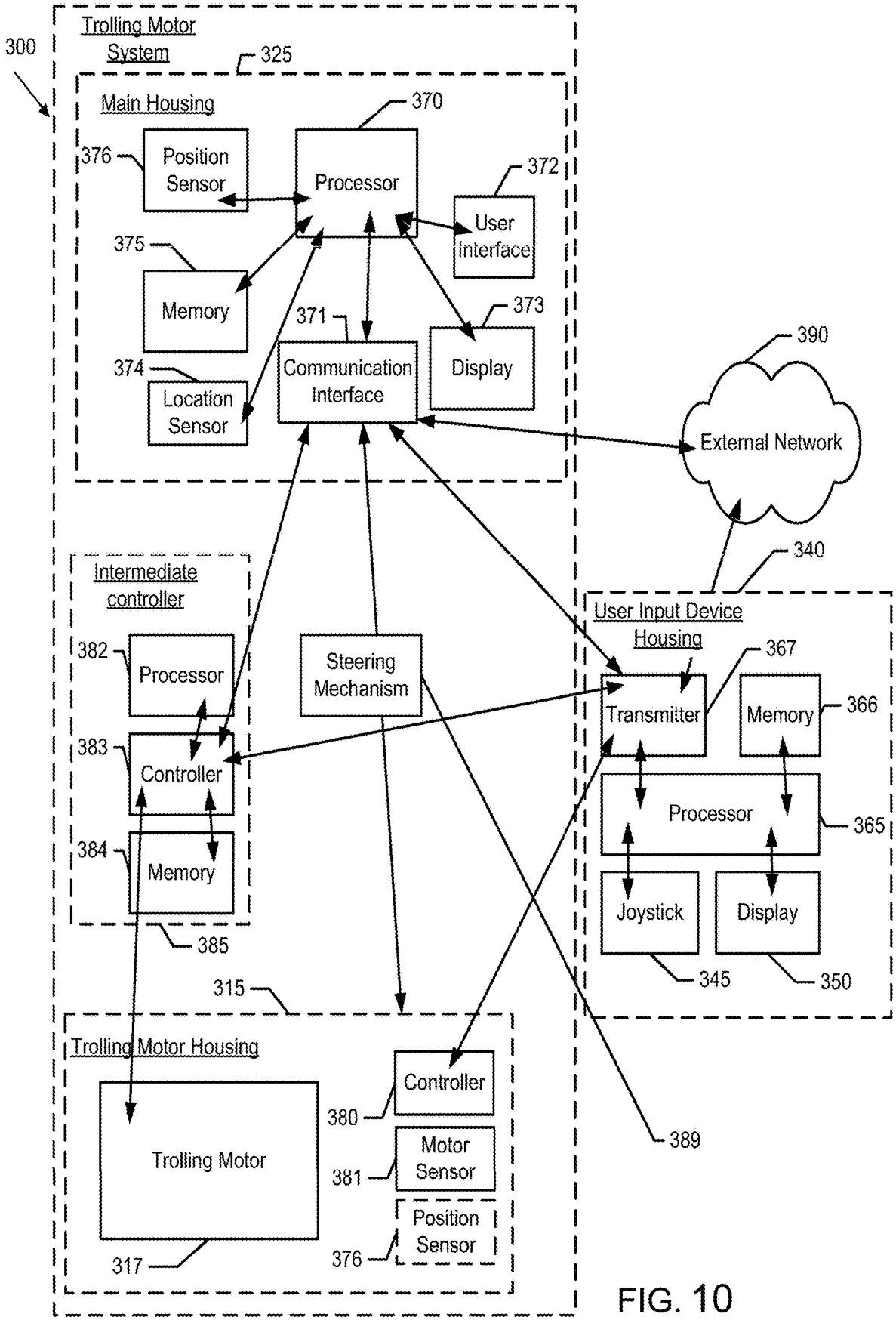
Figure 11:
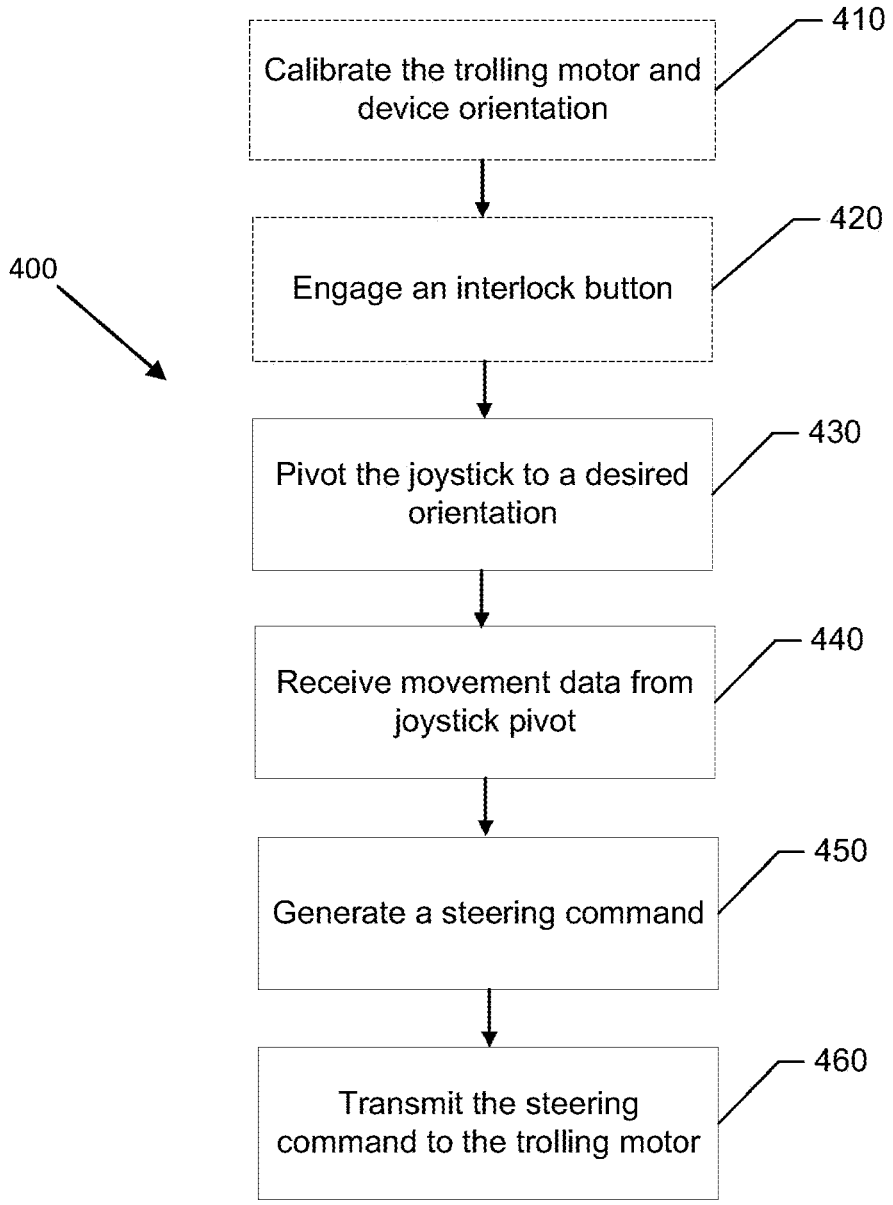

Having thus described the invention in general terms, reference will now be made to the accompanying drawings, which are not necessarily drawn to scale, and wherein:

FIG. 1 illustrates an example trolling motor attached to a front of a watercraft, in accordance with some embodiments discussed herein;

FIG. 2 illustrates an example trolling motor system, in accordance with some embodiments discussed herein;

FIGS. 3A-B illustrate an example conventional handheld device being used with a trolling motor to steer the trolling motor, in accordance with some embodiments discussed herein;

FIG. 4A illustrates a front view of an example handheld device, in accordance with some embodiments discussed herein;

FIG. 4B illustrates a rear view of the example handheld device, in accordance with some embodiments discussed herein;

FIG. 4C illustrates a side view of the example handheld device, in accordance with some embodiments discussed herein;

FIGS. 5A-5C illustrate an example handheld device being used to steer a trolling motor of a watercraft, in accordance with some embodiments discussed herein;

FIGS. 6A-6C illustrate an example handheld device being used to steer a trolling motor of a watercraft, in accordance with some embodiments discussed herein;

FIGS. 7A-7C illustrate an example handheld device being used to steer a trolling motor of a watercraft, in accordance with some embodiments discussed herein;

FIGS. 8A-8B illustrate an example handheld device being used to control a speed component of a trolling motor of a watercraft, in accordance with some embodiments discussed herein;

FIG. 9 illustrates an example handheld device being used to engage a virtual anchoring protocol for a trolling motor, in accordance with some embodiments discussed herein;

FIG. 10 shows a block diagram illustrating a marine system including an example user input device (e.g., handheld, mounted, etc.), in accordance with some embodiments discussed herein; and FIG. 11 illustrates a flow chart of an example method for steering the trolling motor with the example user input device, in accordance with some embodiments discussed herein.

DETAILED DESCRIPTION

Example embodiments of the present invention now will be described more fully hereinafter with reference to the accompanying drawings, in which some, but not all embodiments of the invention are shown. Indeed, the invention may be embodied in many different forms and should not be construed as limited to the example embodiments set forth herein; rather, these embodiments are provided so that this disclosure will satisfy applicable legal requirements. Like reference numerals refer to like elements throughout.

As used herein the term "forward" is used to describe the direction of the heading of the watercraft 10, such as directed outwardly in line with a centerline of the watercraft and from the fore part 11 of the watercraft (see FIGS. 5B-C).

FIG. 1 illustrates an example watercraft 10 on a body of water 101. The watercraft 10 has a trolling motor assembly 100 attached to its front by a trolling motor mount 121, with a trolling motor housing 115 submerged in the body of water 101. The trolling motor within the trolling motor housing 115, which may be gas-powered or electric, for example, may be used as a propulsion system to provide thrust so as to cause the watercraft 10 to travel along the surface of the water 101. The trolling motor assembly 100 may also include a main housing 125 positioned out of the water and at a top of a shaft 105. While the depicted embodiment shows the trolling motor assembly 100 attached to the front of the watercraft 10 as a secondary propulsion system, example embodiments described herein contemplate that the trolling motor assembly 100 may be attached in any position (e.g., the rear or side) on the watercraft 10 and/or may serve as the primary propulsion system for the watercraft 10.

Moreover, steering may be accomplished, via a remote control. Additionally, in some cases, an autopilot may operate the trolling motor 117 autonomously.

FIG. 2 illustrates an example trolling motor assembly 100. The trolling motor assembly 100 may include a shaft 105 having a first end 107 and a second end 109 defining a trolling motor shaft axis A1 extending therebetween. The trolling motor assembly 100 may include a main housing 125 attached to the first end 107 of the shaft 105, and a trolling motor housing 115 attached to the second end 109 of the shaft 105. In some embodiments, when the trolling motor assembly 100 is attached to the watercraft 10 and the trolling motor 117, or trolling motor housing 115 is submerged in the water 101, the trolling motor 117 is configured to propel the watercraft 10 to travel along the body of water 101. In addition to containing the trolling motor 117, the trolling motor housing 115 may include other components described herein including, for example, a propeller 117*a*, a sonar transducer assembly and/or other sensors.

The main housing 125 is positioned outside of the water and is connected to the shaft 105 proximate the first end 107 of the shaft 105. The main housing 125 may be configured to house components of the trolling motor assembly 100, such as may be used for processing marine or sensor data and/or controlling operation of the trolling motor among other things. For example, with reference to FIG. 10, depending on the configuration and features of the trolling motor assembly 100, the main housing 125 may contain, for example, one or more processors 370, memory 375, location sensor 374, position sensor 376, communication interface 371, user interface 372, or a display 373.

The trolling motor assembly 100 may further include an attachment feature 120 (e.g., a trolling motor mount 121, a clamp, other attachment means) to enable connection or attachment of the trolling motor assembly 100 to the watercraft 10. In some embodiments, the attachment feature 120 may be configured to aid and assist in rotation of the trolling motor shaft 105 about the shaft axis so as to steer the watercraft 10. In other embodiments, the attachment feature 120 may be configured to not hinder the rotation of the shaft 105. In some embodiments, the attachment feature 120 may be configured to remove the trolling motor 100 from the water 101 by rotating the trolling motor 100 to the deck of the watercraft 10, or by removing the trolling motor 100 from the watercraft 10.

The trolling motor assembly 100 may be in electrical communication with a remote device 200. In some embodiments, the remote device 200 may be in communication with the main housing 125, the trolling motor housing 115, an external network 390 (See FIG. 10), and/or an intermediate controller 385. In some embodiments, the remote device 200 may be handheld to be used at any location within the watercraft 10, while in other embodiments, the remote device 200 may be mounted at the helm 13 of the watercraft 10. In some embodiments, the intermediate controller 385 may be mounted at the helm 13, or within the remote device 200.

Although previous remote devices have been used to steer trolling motors, they afford minimal utility. As illustrated in FIG. 3A, a conventional handheld device 200' includes a push pad 230' having a left side button 231' and a right side button 232'. When the left side button 231' is pressed the trolling motor housing 115 rotates counterclockwise, and when the right side button 232' is pressed the trolling motor housing 115 rotates clockwise. The trolling motor housing 115 will continue to rotate while either the left side button 231' or the right side button 232' is engaged and cease rotation upon disengagement. Although there may be an indication of the trolling motor orientation indicated on the trolling motor main housing 110, to achieve a desired direction either the left side button 231' or the right side button 232' must be disengaged at exactly the right time to reach, but not over shoot the desired orientation of the trolling motor housing 115.

FIG. 3A illustrates an case where the trolling motor housing 115 is oriented to propel the watercraft 10 forward in relation to the fore part 11 of the watercraft 10. A user may engage the left side button 231' to direct the trolling motor housing 115 to rotate counterclockwise (e.g., left) as illustrated by the arrow. Since the trolling motor was oriented in the forward direction the trolling motor housing 115 and thereby the forward facing direction of the watercraft 10 rotates counterclockwise after the trolling motor engages and propels the watercraft 10 a certain distance.

However, in some embodiments, when the trolling motor housing 115 is not aligned with the forward facing direction, engagement with either the left side button 231' or the right side button 232' will result in a counter intuitive rotation of the trolling motor housing 115. For example, as illustrated in FIG. 3B, the trolling motor housing 115 is oriented to propel the watercraft 10 opposite the forward direction. Engaging the left side button 231' will rotate the trolling motor housing 115 counterclockwise from the starting orientation. In the present example, the trolling motor housing 115 would rotate counterclockwise, such that the propeller 117*a* of the trolling motor 117 has rotated to the left in relation to the forward direction. When the trolling motor 117 is engaged the watercraft 10 will rotate clockwise due to the orientation of the trolling motor 117 housing (and the mounting of the trolling motor on the fore part 11 of the watercraft 10).

Therefore, in the present example, the intuitive action, pressing the left side button 231' to rotate the trolling motor 117 and thereby steer the watercraft 10 in the desired direction is incorrect, and will result in the opposite direction of rotation and travel. Accordingly, for a user to accurately steer the watercraft 10, the user must look to the current orientation of the trolling motor (e.g., see the indication on the main housing 110), determine the desired direction, engage the correct button of the push pad 230' and release the button of the push pad 230' at the correct time in order to steer the trolling motor housing 115 and/or the watercraft 10 in the desired direction.

The present invention relates to a handheld remote device to steer a trolling motor in a desired direction, regardless of the current orientation of the trolling motor propeller. FIGS. 4A-C illustrate views of the example device 200. The device 200 may include a housing 240 having a first side 243 and a second side 244. In some embodiments, the housing 240 may define a top side 240*a* and a bottom side 240*b*. The top side 240*a* and bottom side 240*b*, may be integral to one another, and in some embodiments, may provide a watertight connection. The housing 240 may be made from a plastic material, another easily waterproofable material, and/or a material that will float. The housing 240 may be configured to be easily held in one hand of the user and may be ergonomically configured. The housing 240 may further be configured such that digits of the hand (including the thumb) may engage the different components arranged within the housing 240 without fatigue and/or undue motion. The device 200 may be configured so as to be easily be operated by the users left or right hand. The device 200 may be configured to be useable in any orientation, such as a vertical position or a horizontal position. In some embodiments, the device 200 may be configured to be mounted, such as to a helm of a watercraft. In some embodiments, though the device 200 is described as being handheld, it may be permanently (or semi-permanently) mounted and not be held within a hand of a user, as the handheld nature of the device 200 is used for an example in the various described embodiments herein.

The device 200 may include a joystick 245 attached to the housing 240 between the first side 243 and the second side 244. The joystick 245 may be formed such that a portion of the joystick 245 is external to the housing 240, and a portion of the joystick 245 is in the interior of the housing 240. The joystick 245 may include a rotation member 249 (see FIGS. 4C & 5B) in the interior of the housing 240, surrounded by a collar 248 on the exterior of the housing 240. A stick 247 having a top face 246 may be attached to the rotation member 249, wherein the stick 247 and the top face 246 extend from the rotation member 249 outside of the housing 240. In some embodiments, the rotation member 249 may be formed as a hemisphere and the stick 247 may be attached to a top pole of the hemisphere.

In some embodiments, the joystick 245 may be pivotably supported for movement from a neutral position in directions radial to an axis A1, see FIG. 4C, of the joystick 245. The neutral position, in the illustrated embodiment, is the position of the joystick 245 when there are no outside forces (e.g., radial pressure; axial pressure) applied, and the stick 247 of the joystick 245 is centered on the axis A1. The joystick 245 may be configured to pivot in all directions (e.g.) 360° about the axis, and may be rotatable between positions. In some embodiments, the movement of the joystick 245 from the neutral position may create one or more commands, such as a steering command. The steering command may be for the trolling motor 117 of the trolling motor assembly 100 to rotate to a heading corresponding to the joystick movement.

In some embodiments, with reference to FIG. 8A, a pressure sensor 253 may be positioned relative to the collar 248 of the joystick 245. The pressure sensor 253 may be configured to determine the amount of pressure applied to the collar 248 by movement of the stick 247. In some embodiments, the pressure sensor 253 may be configured as a potentiometer, such as within the joystick 245. In some embodiments, the detected pressure may create one or more commands, such as indicating a desired thrust (which may be added or separate from the steering command). In some embodiments, the thrust component may be based on a predetermined setting wherein an amount of thrust varies with respect to an amount of pressure applied to the joystick 245. In some embodiments, the thrust component may be disabled.

In some embodiments, the joystick 245 may be configured to include a button. The joystick 245 may be configured such that the top face 246 may be pressed towards the housing 240 thereby depressing the rotation member 249. The depression of the rotation member 249 may generate a command. In some embodiments, the command may be selectable when the device 200 is programed. The command may, for example, be to engage and disengage: an auto pilot, a virtual anchor, a propeller, a user interface, or other commands related to features of the trolling motor assembly 100.

The housing 240 may further include at least one button 255 disposed between the joystick 245 and the second side 244. In some embodiments, the at least one button 255 may be positioned around the joystick 245. In some embodiments, the at least one button 255 may be connected to a processor to thereby engage and/or disengage a feature of the trolling motor assembly 100. In some embodiments, the feature may be the virtual anchor, the propeller, the autopilot, the user interface, and/or an interlock. In some embodiments, the at least one button 255 may be configured to engage and/or disengage a propeller, turn an autopilot on and/or off, or provide input to a user interface. In some embodiments, the device 200 may be configured with three buttons 255*a*, 255*b*, and 255*c*, wherein each of the buttons 255*a*, 255*b*, 255*c* may correspond to a different feature of the trolling motor assembly 100. Although three buttons are illustrated, any number of buttons may be used, as this list should not be considered exhaustive, and other features and uses are considered. Further, although the buttons illustrated are tactile buttons, other user inputs are contemplated (e.g., touchscreen icons, touch buttons, sliders, etc.).

In some embodiments, the device 200 may further include a display screen 250 within the housing 240. In some embodiments, the display screen 250 is positioned in front of the joystick 245 proximate to the first side 243 of the housing 240. The display screen 250 may be configured to present marine data to the user. In some embodiments, the marine data may include the speed of the watercraft 10, the heading of the watercraft 10, current temperature, water temperature, weather forecast, a compass, sonar imagery, or any other marine data.

In some embodiments, the display screen 250 may include a display button 251 integral with or adjacent to the display screen 250. In some embodiments, the display button 251 may be configured to turn the display screen 250 on and off, while in other embodiments the display button 251 may be configured to change the marine data presented on the display screen 250. In some embodiments, the display button 251 may be configured to rotate through the marine data displayed, when engaged through a short press, and to turn the screen on and off when the button is held for a predetermined amount of time. In some embodiments, the display button 251 may be a toggle or other user input device capable of scrolling or toggling through menu selections and/or providing similar display selection functionality.

In some embodiments, the device 200 may include at least one bottom button 260, as illustrated in FIG. 4B. The bottom button 260 may be positioned between the first side 243 and the second side 244. In some embodiments, the bottom button 260 may be positioned opposite the joystick 245, and in other embodiments, the bottom button 260 may be positioned closer towards one of the first side 243, or the second side 244. In some embodiments, the bottom button 260 and the joystick 245 are positioned within the housing 240 such that a user may rest a thumb on the top face 246 of the joystick 245 while resting another digit (e.g., a pointer finger) on the bottom button 260. In some embodiments, the bottom button 260 may function as an interlock button. To explain, the bottom button 260 may have an engaged position and a disengaged position. The device 200 may be configured to generate a steering command when the bottom button 260 is in the engaged position, and not generate a steering command when the bottom button 260 is in the disengaged position. The use of the bottom button 260 as an interlock, may prevent undesired rotation and/or movement of the trolling motor housing 115, and thereby the watercraft 10. In some embodiments, one of the at least one buttons 255*a,b,c* or the joystick button may be configured as an interlock, while the bottom button 260 is configured to correspond to a different feature of the trolling motor assembly.

The bottom side 240*b* of the housing may further include a removable cover 259. The removable cover 259 may be configured to provide access to a battery compartment, or to other components within the housing (e.g., processor, transmitter, and/or other computer elements).

In some embodiments, a retention device 257 may be attached to the second side 244 of the housing 240. In some embodiments, the retention device 257 may be a wrist strap, a clip or other attachment device to allow the user to keep the device 200 close to a user. In some embodiments, a floatation device may be attached to the device 200, such as via the retention device 257.

The device 200 may be in wireless communication with the trolling motor assembly 100 (e.g., directly or through other marine electronic device(s)). More specifically the device 200 may transmit the commands generated by the movement and engagement of the components of the device 200 to the tolling motor assembly 100, to rotate the trolling motor housing 115 so as to aim in the steer direction, such as to aim the trolling motor housing 115 (e.g., for sonar usage and/or to cause the watercraft 10 to travel in a direction corresponding to the joystick 245 movement). In some embodiments, the device 200 may be in wired communication with the trolling motor assembly 100, for example the device may be positioned within the helm 13 of the watercraft 10 and have at least one wire between the main housing 115 and the helm 13. In some embodiments, when the device 200 is within the helm 13, the device may be in wireless communication with the trolling motor assembly 100.

The device 200 may be calibrated such that the steering commands are generated in relation to the forward facing direction of the watercraft 10. In some embodiments, the forward facing direction may be the direction of the heading of the watercraft 10. The device 200 may determine an angle of difference between the direction of movement of the joystick 245 and the forward facing direction. In some embodiments, the angle of difference may be used to determine the steer direction so as to cause the watercraft 10 to travel in the direction corresponding to the joystick 245 movement.

In an example embodiment, as illustrated in FIGS. 5A-C, the device 200 and trolling motor assembly 100 may be calibrated such that pivoting the joystick 245 towards the first side 243 of the device 200 causes the trolling motor housing 115 to rotate such that the propeller 117*a* is oriented to propel the watercraft 10 in the forward facing direction. FIG. 5A illustrates a split view including a top view of the device 200 wherein the joystick 245 is in the neutral position, a side view of the watercraft 10 wherein the propeller 117*a* is oriented in a direction other than the forward facing direction, and a top view of the watercraft 10 illustrating the forward facing direction. As illustrated in FIG. 5A, the watercraft 10 defines a centerline 10*a* extending between the bow and the stern of the watercraft 10. In some embodiments, the forward facing direction along the centerline 10*a* extends past the bow of the watercraft 10. The forward facing direction is independent of the orientation of the trolling motor 117.

FIG. 5B illustrates a similar split view, illustrating the device 200 and the watercraft 10 and the trolling motor assembly 100. The joystick 245 of the device is pivoted from the neutral position such that the top face 246 is towards the first side 243 of the device 200 thereby generating a steering command. The device 200 sends a signal 30 to the trolling motor assembly 100 containing the steering command. The trolling motor assembly 100 receives the steering command and rotates the trolling motor 117 such that the propeller 117*a* starts orienting directly to the desired direction to enable propelling the watercraft 10 in the desired direction. FIG. 5B shows a top view and a side view of the beginning orientation of the propeller 117*a* and the direction of rotation. FIG. 5C illustrates another similar split view, illustrating a side view and a top view of the watercraft 10 after the trolling motor assembly 100 executes the steering command and the trolling motor 117 is rotated so as to cause the trolling motor 117 to be oriented in the desired direction (which is the direction the joystick is pointing). This enables the watercraft 10 to travel in the desired direction corresponding to the joystick 245 movement.

In some embodiments, the user may generate the steering command by pivoting the joystick 245 to the desired direction and returning the joystick 245 to the neutral position. The movement may indicate a specific heading such that the trolling motor assembly 100 rotates to the desired direction indicated by the immediate movement of the joystick.

In other embodiments, the user may hold the joystick 245 in the pivoted position until the trolling motor has rotated to the desired direction. In contrast to the conventional device 200', which allows the trolling motor to rotate until the button is disengaged, here device 200 may be configured to rotate the trolling motor assembly 100 to the desired direction and then cease any further rotation, even with the joystick 245 still in the pivoted position. In still other embodiments, the user may generate the steering command with active movement of the joystick 245. The user may pivot the joystick 245 to indicate the desired direction, and as the trolling motor assembly 100 and/or the watercraft 10 rotate to the direction, the user may adjust the pivot angle to bring the trolling motor assembly 100 back in line so that the trolling motor propeller is oriented with the forward facing direction of the watercraft 10.

A user may calibrate the device 200, such that when the top face 246 of the joystick 245 is pivoted from the neutral position to a desired direction, the trolling motor 117 rotates to face the desired direction, independent of the starting orientation of the trolling motor 117 and specific to the calibrated direction. For example, the user may wish "backwards" relative to the watercraft to be the generally "forward" direction on the device 200. In an example embodiment, illustrated in FIGS. 6A-C, the trolling motor assembly 100 is configured to rotate the trolling motor 117 to be oriented in the desired direction as indicated by the movement of the joystick 245. FIG. 6A illustrates a split view, including a top view of the device 200 wherein the joystick 245 is in the neutral position, and a side view of the watercraft 10 wherein the propeller is oriented to indicate that the trolling motor 117 is in the forward facing direction.

FIG. 6B illustrates a similar split view, illustrating the device 200, and the watercraft 10 and the trolling motor assembly 100. The joystick 245 of the device is pivoted from the neutral position such that the top face 246 is in a diagonal direction towards the right side of the first side 243 of the device 200—thereby generating a steering command. The device 200 may send the signal 30 to the trolling motor assembly 100 containing the steering command. The trolling motor assembly 100 may receive the steering command and rotate the trolling motor 117 such that the propeller 117*a* is oriented such that the trolling motor 117 is facing the desired direction, such as to propel the watercraft 10 in the desired direction communicated from the steering command. FIG. 6B illustrates a top view and a side view of the beginning orientation of the propeller 117*a* and the direction of rotation. FIG. 6C illustrates a side view and a top view of the watercraft 10 after the trolling motor assembly 100 executes the steering command and the trolling motor 117 is rotated so as to cause the watercraft 10 to travel in the desired direction corresponding to the joystick 245 movement.

As the steering is correlated to the forward facing direction of the watercraft 10, pivoting the joystick 245 in any direction (e.g., diagonal, left, right, up, down, slightly above left, etc.) will generate a steering command to rotate the trolling motor 117 directly to correspond to the movement of the joystick 245. Further, the trolling motor 117 is not limited to rotating clockwise or counterclockwise, as the steering command is based on the forward facing direction and not rotation direction.

In another example embodiment, illustrated in FIGS. 7A-7C, the trolling motor assembly 100 is configured to rotate the trolling motor housing 115 to the desired direction as indicated by the movement of the joystick 245. FIG. 7A illustrates a split view, including a top view of the device 200 wherein the joystick 245 is in the neutral position, and a side view of the watercraft 10 wherein the trolling motor 117 is oriented in a direction other than the forward direction.

FIG. 7B illustrates a similar split view of the device 200 and the watercraft 10 and the trolling motor assembly 100. The joystick 245 of the device is pivoted from the neutral position such that the top face 246 is in a diagonal direction to the right side of the first side 243 of the device 200—thereby generating a steering command. The device 200 sends the signal 30 containing the steering command to the trolling motor assembly 100. The trolling motor assembly 100 receives the steering command and rotates the trolling motor 117 such that the propeller 117*a* is oriented such that the trolling motor 117 is facing the desired direction, such as to propel the watercraft 10 in the desired direction communicated from the steering command. Since the steering command may be independent of the starting orientation of the trolling motor 117, the trolling motor assembly 100 may rotate the trolling motor 117 either counterclockwise A2 or clockwise A3 to reach the desired direction depicted so as to cause the watercraft 10 to travel in the desired direction corresponding to the joystick 245 movement.

In some embodiments, the trolling motor assembly 100 may include logic to determine the rotation direction from the current orientation to the desired direction. In some embodiments, a position sensor 376 (FIG. 10) on the trolling motor housing 115 may transmit orientation data of the trolling motor 117. The trolling motor assembly 100 may receive the orientation data and determine a path of least rotation between the orientation of the trolling motor 117 and the desired direction of the steering command. Alternatively, in some embodiments, the trolling motor housing 115 may always rotate counterclockwise if the joystick 245 is pivoted to the left of the neutral position and rotate clockwise if the joystick 245 is pivoted to the right of the neutral position. Along similar lines, in some embodiments, the trolling motor housing 115 may always rotate counterclockwise, and in other embodiments the trolling motor housing 115 may always rotate clockwise. In some embodiments, the trolling motor assembly 100 may be configured to rotate the trolling motor housing 115 to the forward facing direction after the watercraft 10 reaches the desired direction, such as to maintain a neutral position for easy rotation. In some embodiments, the trolling motor assembly 100 may maintain the heading of the propeller 117 but turn off the motor such that the watercraft 10 moves for example due to the water currents, wind, and/or the shape of the hull of the watercraft 10.

The device 200 may be configured to designate a thrust component of the steering command. In some embodiments, the pressure sensor 253 may be positioned relative to the joystick 245, such as integral to the collar 248. The pressure sensor 253 be configured to detect the amount of pressure applied when the joystick 245 is pivoted from the neutral position. FIG. 8A illustrates a first example, wherein the joystick 245 is pivoted slightly towards the first side 243 of the device 200 indicating a forward facing direction of the trolling motor housing 115. The slight pivot applies a relatively small amount of pressure to the pressure sensor 253 thereby generating a speed component of the steering command. The speed of the trolling motor 117 may vary with the amount of pressure detected by the pressure sensor 253. In an example embodiment, a low pressure may indicate a low speed component, (e.g., low speed of travel), as indicated by arrow 197.

FIG. 8B illustrates another example, wherein the joystick 245 is pivoted, such that the stick 247 is touching the collar 248 towards the first side 243 of the device 200 indicating a forward direction of the trolling motor housing 115. The large pivot applies a greater amount of pressure to the pressure sensor 253 thereby generating a greater speed component of the steering command, as indicated by arrows 197'.

In some embodiments, a user may set speeds to correspond to varying pressure ranges. For example, a user may determine a first pressure range only rotates the trolling motor housing 115; a second pressure range (e.g., a greater amount of pressure) rotates the trolling motor housing 115 and indicates a first speed component (e.g., 2 miles per hour); and a third pressure range rotates the trolling motor housing 115 and indicates a second speed component (e.g., 4 miles per hour).

The device 200 may additionally be configured to engage a virtual anchor feature in the watercraft 10. As discussed above, and with reference to FIG. 9, various buttons of the device may be pressed to engage features. As illustrated in FIG. 9, either the joystick 245, or one of the buttons 255 may be configured to engage the virtual anchor feature. The user may set an offset distance 195, such as from a predetermined list, and/or any other selection/input means. As an example, a predetermined list for offset distance 195 options may include 1 foot, 5 feet, 10 feet, 20 feet, etc. One skilled in the art would appreciate that any unit of measurement for distance may be utilized for offset distance 195 (e.g., feet, meters, yards, etc.).

During operation, the watercraft 10 may not remain in a static location. In this regard, the location of the watercraft 10 may be impacted by a variety of factors, such as wind speed, water current, rain, tide conditions, other marine vessels, wildlife, etc. To account for such movement, in some embodiments, the user may engage a virtual anchor feature of the trolling motor assembly 100 by pressing the button 255*a* of the device 200. The virtual anchor may be configured to instruct the trolling motor assembly 100 to rotate and engage as needed to enable the watercraft 10 to stay within an outer range 196 having the offset distance 195 by engaging button 255*a*.

Although button 255*a* is used in the present embodiment, any of the buttons 255*a* 255*b* or 255*c* may be programmed to engage the virtual anchor feature. Further, in some embodiments, the joystick 245 button is configured to engage the virtual anchor feature.

Example System Architecture

FIG. 10 shows a block diagram of an example trolling motor system 300 capable for use with several embodiments of the present invention. As shown, the trolling motor system 300 may include a number of different modules or components, each of which may comprise any device or means embodied in either hardware, software, or a combination of hardware and software configured to perform one or more corresponding functions. For example, the trolling motor system 300 may include a main housing 325, a trolling motor housing 315, and an intermediate controller 385. In some cases, the trolling motor system 300 may include a user input device housing 340.

The trolling motor system 300 may also include one or more communications modules configured to communicate with one another in any of a number of different manners including, for example, via a network. In this regard, the communication interface (e.g., 371) may include any of a number of different communication backbones or frameworks including, for example, Ethernet, the NMEA 2000 framework, GPS, cellular, WiFi, or other suitable networks. The network may also support other data sources, including GPS, autopilot, engine data, compass, radar, etc. Numerous other peripheral, remote devices such as one or more wired or wireless multi-function displays may be connected to the trolling motor system 300.

The main housing 325 may include a processor 370, a memory 375, a communication interface 371, a user interface 372, a display 373, one or more sensors (e.g., location sensor 374, a position sensor 376, a motor sensor 381, etc.). Notably, the position sensor 376 and motor sensor 381 are shown in the trolling motor housing 315, although these sensors could be positioned elsewhere (such as in the main housing 325).

The processor 370 may be any means configured to execute various programmed operations or instructions stored in a memory device such as a device or circuitry operating in accordance with software or otherwise embodied in hardware or a combination of hardware and software (e.g., a processor operating under software control or the processor embodied as an application specific integrated circuit (ASIC) or field programmable gate array (FPGA) specifically configured to perform the operations described herein, or a combination thereof) thereby configuring the device or circuitry to perform the corresponding functions of the processor 370 as described herein.

In this regard, the processor 370 may be configured to analyze electrical signals communicated thereto to provide display data to the display to indicate the direction of the trolling motor housing 315 relative to the watercraft.

In some embodiments, the processor 370 may be further configured to implement signal processing or enhancement features to improve the display characteristics or data or images, collect or process additional data, such as time, temperature, GPS information, waypoint designations, or others, or may filter extraneous data to better analyze the collected data. It may further implement notices and alarms, such as those determined or adjusted by a user, to reflect depth, presence of fish, proximity of other watercraft, etc.

The memory 375 may be configured to store instructions, computer program code, marine data, such as chart data, location/position data, heading data and other data associated with the device in a non-transitory computer readable medium for use, such as by the processor.

The communication interface 371 may be configured to enable connection to external systems (e.g., an external network 390). In this manner, the processor 370 may retrieve stored data from a remote, external server via the external network 390 in addition to or as an alternative to the onboard memory 375.

The location sensor 374 may be configured to determine the current position and/or location of the main housing 325. For example, the location sensor 374 may comprise a GPS, bottom contour, inertial navigation system, such as micro electro-mechanical sensor (MEMS), a ring laser gyroscope, or the like, or other location detection system.

The display 373 may be configured to display images and may include or otherwise be in communication with a user interface 372 configured to receive input from a user. The display 373 may be, for example, a conventional LCD (liquid crystal display), an LED display, or the like. The display may be integrated into the main housing 325. In some example embodiments, additional displays may also be included, such as a touch screen display, mobile device, or any other suitable display known in the art upon which images may be displayed.

In any of the embodiments, the display 373 may be configured to display an indication of the current direction of the trolling motor housing 315 relative to the watercraft. Additionally, the display may be configured to display other relevant trolling motor information including, but not limited to, speed data, motor data battery data, current operating mode, auto pilot, or the like.

The user interface 372 may include, for example, a keyboard, keypad, function keys, mouse, scrolling device, input/output ports, touch screen, or any other mechanism by which a user may interface with the system.

The position sensor 376 may be found in one or more of the main housing 325, the trolling motor housing 315, or remotely. In some embodiments, the position sensor 376 may be configured to determine a direction of which the trolling motor housing 315 is facing. In some embodiments, the position sensor 376 may be operably coupled to either the shaft or steering system 330, such that the position sensor 376 measures the rotational change in position of the trolling motor housing 315 as the trolling motor housing 315 is turned. The position sensor 376 may be a magnetic sensor, a magnetometer, an accelerometer, a light sensor, mechanical sensor, or the like.

The trolling motor housing 315 may include a trolling motor 317, and one or more other sensors (e.g., motor sensor 381, position sensor 376, water temperature, current, etc.), which may each be controlled through the processor 370 (such as detailed herein).

In some embodiments, the trolling motor system 300 may include an intermediate controller 385 that includes a processor 382, a controller 383 and a memory 384. The processor 382 of the intermediate controller 385 may receive and analyze electrical signals communicated thereto to provide rotation instructions to a steering mechanism 389 configured to rotate the trolling motor housing 315 about the shaft and change the orientation or the trolling motor housing 315 to steer the watercraft.

In some example embodiments, the trolling motor system 300 may be in communication with a user input device 340. The user input device 340 may include a joystick 345, and a display 350, which may be connected to the processor 365. In some embodiments, one or more buttons may be included in the user input device (such as described in various embodiments herein).

The user input device housing 340 further includes a transmitter 367, and a memory 366 coupled with the processor 365. The joystick 345 may be pivoted within the housing 340, and the movement of the joystick 345 may be received by the processor 365 and memory 366 and converted into an electrical signal transmitted by the transmitter 367. In some embodiments, the signal may be sent from the transmitter 367 to the communications interface 371 in the main housing 325, the controller 383 of the intermediate controller 385, the external network 390, or directly to the controller 380 of the trolling motor housing 315.

In some embodiments, the trolling motor system 300 may include additional sensors, for example, a speed sensor, such as an electromagnetic speed sensor, paddle wheel speed sensor, or the like configured to measure the speed of the watercraft through the water.

In some embodiments, the trolling motor system 300 may include a motor sensor. The motor sensor may be a voltage sensor, a rotation per minute (RPM) sensor, a current sensor or other suitable sensor to measure the output of the trolling motor 317.

In some embodiments, the trolling motor system 300 may include a battery sensor. The battery sensor may include a current sensor or voltage sensor configured to measure the current charge of a battery power supply of the trolling motor system 300.

Example Flowchart(s) and Operations

Some embodiments of the present invention provide methods, apparatus, and computer program products related to controlling a trolling motor according to various embodiments described herein. Various examples of the operations performed in accordance with embodiments of the present invention will now be provided with reference to FIG. 11.

FIG. 11 illustrates a flowchart according to an example method of steering a trolling motor system according to an example embodiment. The operations listed in and described with respect to FIG. 11 may for example be performed with the assistance of and/or under the control of one or more processors 370, 365, 382, controller 383, 380, trolling motor systems 300, memory 375, 366, 384, communication interfaces 371, 367, user interfaces 372, user input devices 340, joysticks 345, buttons, displays 350, 373, steering mechanisms 389, location sensor 374, and/or position sensor 376.

The method for steering a trolling motor with a remote device depicted in FIG. 11 may optionally include calibrating the trolling motor and device (e.g., user input device) orientation at operation 410. The device may be calibrated such that when the joystick is moved from the neutral position towards the first side of the device, the trolling motor is rotated so as to face in the forward direction with respect to the watercraft. After calibration, the method 400 may optionally continue by engaging an interlock button at operation 420. In some embodiments, an interlock button may be provided to prevent incidental or accidental movements of the joystick being translated into movement of the watercraft. The method 400 may continue by pivoting the joystick to a desired orientation at operation 430. The method 400 may continue by receiving the movement data from the joystick movement at the processor at operation 440. The method 400 may continue by generating a steering command at operation 450. In some embodiments, the steering command correlates to the movement data, wherein the position of the joystick, the speed of the movement, and/or the force applied about the movement may correlate to the desired direction and/or desired thrust of the steering command. The method 400 may continue by transmitting the steering command to the trolling motor at operation 460.

FIG. 11 illustrates a flowchart of a system, method, and computer program product according to an example embodiment. It will be understood that each block of the flowcharts, and combinations of blocks in the flowcharts, may be implemented by various means, such as hardware and/or a computer program product comprising one or more computer-readable mediums having computer readable program instructions stored thereon. For example, one or more of the procedures described herein may be embodied by computer program instructions of a computer program product. In this regard, the computer program product(s) which embody the procedures described herein may be stored by, for example, the various described memory and executed by, for example, the various described processor(s). As will be appreciated, any such computer program product may be loaded onto a computer or other programmable apparatus to produce a machine, such that the computer program product including the instructions which execute on the computer or other programmable apparatus creates means for implementing the functions specified in the flowchart block(s). Further, the computer program product may comprise one or more non-transitory computer-readable mediums on which the computer program instructions may be stored such that the one or more computer-readable memories can direct a computer or other programmable device to cause a series of operations to be performed on the computer or other programmable apparatus to produce a computer-implemented process such that the instructions which execute on the computer or other programmable apparatus implement the functions specified in the flowchart block(s).

CONCLUSION

Many modifications and other embodiments of the inventions set forth herein will come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

That which is claimed:

1. A handheld device for steering a trolling motor of a watercraft, the handheld device comprising:

a housing;

a joystick attached to the housing and pivotably supported for movement from a neutral position in directions radial to an axis of the joystick, wherein the movement from the neutral position generates a steering command for the trolling motor;

a transmitter within the housing;

a processor communicatively coupled to the transmitter and the joystick; and a memory including a computer program product stored thereon, wherein the computer program product is configured, when executed by the processor, to:

receive movement data from the joystick including a direction of movement from the neutral position, wherein the direction of movement from the neutral position defines a joystick direction and occurs over 360 degrees;

generate, based on the movement data, the steering command for instructing the trolling motor to aim in a steer direction that directly corresponds to the joystick direction, wherein the steer direction is a pointing direction of the trolling motor for directing propulsion of the trolling motor, wherein the steer direction occurs over 360 degrees;

transmit the steering command to the trolling motor, wherein the steering command causes the trolling motor to rotate so as to aim in the steer direction to cause the watercraft to travel based on movement of the joystick;

continuously generate steering commands based on adjustments in the direction of movement from the neutral position of the joystick; and correspondingly, transmit the steering commands to the trolling motor to cause the trolling motor to adjust the steer direction to match a corresponding joystick direction for each of the adjustments in the direction of movement from the neutral position of the joystick.

2. The handheld device of claim 1, further comprising a button having an engaged position and a disengaged position attached to the housing opposite the joystick so as to form a trigger, wherein the computer program code is further configured, when executed by the processor to:

determine that the button is in the engaged position; and generate the steering command if the button is in the engaged position.

3. The handheld device of claim 1, further comprising a pressure sensor positioned relative to the joystick, wherein the pressure sensor generates a pressure indication from radial movement of the joystick from the neutral position, and wherein the computer program code is further configured, when executed by the processor, to:

receive the pressure indication from the pressure sensor;

generate, based on the pressure indication, a thrust command for instructing the trolling motor to operate according to a speed, wherein a degree of thrust varies with respect to a degree of pressure applied to the joystick; and transmit the thrust command to the trolling motor.

4. The handheld device of claim 1, wherein the joystick further comprises a joystick button, wherein the joystick button is moveable between a disengaged position and an engaged position, wherein the joystick button is moved to the engaged position by pressing a top face of the joystick into the housing.

5. The handheld device of claim 4, wherein the joystick button, when pressed into the engaged position, generates a virtual anchor signal, and wherein the computer program product is further configured, when executed by the processor, to:

receive engagement data from the joystick button;

generate, based on the engagement data, the virtual anchor signal for instructing the trolling motor to engage in a virtual anchor protocol; and transmit the virtual anchor signal to the trolling motor, instructing the trolling motor to engage the virtual anchor protocol to cause the watercraft to maintain a current position.

6. The handheld device of claim 1, further comprising at least one button positioned adjacent the joystick, wherein the at least one button is configured to generate a command when engaged, and wherein the when the computer program product, when executed by the processor to:

receive engagement data from the at least one button;

generate, based on the engagement data, the command for instructing the watercraft; and transmit the command to the watercraft.

7. The handheld device of claim 6, wherein the command is selected from the group consisting of: engage a propeller; turn on an autopilot; provide input to a user interface; disengage the propeller, and turn off the autopilot.

8. The handheld device of claim 1, further comprising a display, wherein the display is positioned adjacent the joystick on the housing.

9. The handheld device of claim 8, wherein the display is configured to present marine data.

10. The handheld device of claim 1, wherein the computer program product is further configured, when executed by the processor to:

receive orientation data from a position sensor, wherein the orientation indicates an orientation of the trolling motor; and determine a path of least rotation between the orientation of the trolling motor and the steer direction.

11. The handheld device of claim 10, wherein the steering command indicates the trolling motor to rotate counterclockwise to the steer direction.

12. The handheld device of claim 10, wherein the steering command indicates the trolling motor to rotate clockwise to the steer direction.

13. The handheld device of claim 1, wherein the computer program product, is further configured, when executed by the processor to:

assign a forward direction to movement of the joystick from the neutral position, wherein the forward direction corresponds to a forward direction of the watercraft;

determine an angle of difference between the direction of movement of the joystick and the forward direction; and determine the steer direction based on the angle of difference.

14. A system for use with a watercraft, the system comprising:

a trolling motor assembly comprising:

a shaft having a first end and a second end defining a shaft axis extending between the first end and the second end;

a trolling motor at least partially contained within a trolling motor housing, wherein the trolling motor housing is attached to the second end of the shaft, wherein, when the trolling motor assembly is attached to the watercraft and the trolling motor housing is submerged in a body of water, the trolling motor, when operating, is configured to rotate about the shaft axis and propel the watercraft to travel along the body of water; and a main housing connected to the shaft proximate the first end of the shaft, wherein the main housing is configured to be positioned out of the body of water when the trolling motor assembly is attached to the watercraft and the trolling motor housing is submerged in the body of water;

a user input assembly comprising:

a housing;

a joystick attached to the housing pivotably supported for movement from a neutral position in directions radial to an axis of the joystick, wherein a movement from the neutral position generates a steering command for the trolling motor;

a transmitter within the housing communicatively coupled to a controller;

a processor communicatively coupled to the transmitter and the joystick; and a memory including a computer program product stored thereon, wherein the computer program product is configured, when executed by the processor, to:

receive movement data from the joystick including a direction of movement from the neutral position, wherein the direction of movement from the neutral position defines a joystick direction and occurs over 360 degrees;

generate, based on the movement data, the steering command for instructing the trolling motor to aim in a steer direction to directly correspond to the joystick direction, wherein the steer direction is a pointing direction of the trolling motor for directing propulsion of the trolling motor, wherein the steer direction occurs over 360 degrees;

transmit the steering command to a controller, wherein the steering command indicates a rotation about the shaft axis so as to aim the trolling motor in the steer direction corresponding to movement of the joystick movement;

continuously generate steering commands based on adjustments in the direction of movement from the neutral position of the joystick; and correspondingly, transmit the steering commands to the trolling motor to cause the trolling motor to adjust the steer direction to match a corresponding joystick direction for each of the adjustments in the direction of movement from the neutral position of the joystick; and wherein the controller is configured to cause the trolling motor to rotate about the shaft axis to aim in the steer direction to cause the watercraft to travel based on the movement of the joystick.

15. The system of claim 14, wherein the user input assembly further comprises a trigger button disposed opposite the joystick, wherein the trigger button is moveable between an engaged position and a disengaged position, wherein the steering command is generated when the trigger button is in the engaged position.

16. The system of claim 14, wherein the joystick further comprises a joystick button, wherein the joystick button is moveable between a disengaged position and an engaged position, wherein the joystick button is moved to the engaged position by pressing a top face of the joystick into the housing.

17. The system of claim 16, wherein a virtual anchor command is generated when the joystick button is engaged, and wherein the computer program product is further configured, when executed by the processor, to:

receive engagement data from the joystick button;

generate, based on the engagement data, the virtual anchor command for instructing the controller to keep the watercraft at a current position; and transmit the virtual anchor command to the controller, wherein the virtual anchor command causes the controller to rotate the trolling motor about the shaft axis to cause the watercraft to maintain the current position.

18. The system of claim 14, wherein the controller is within the main housing of the trolling motor.

19. The system of claim 14, wherein the controller is in a remote marine electronic device at a helm of the watercraft.

20. A method of steering a watercraft, the method comprising:

receiving movement data from a joystick of a user input device, wherein the user input device comprises:

a housing attached to the joystick, wherein the joystick is pivotably supported for movement from a neutral position in directions radial to an axis of the joystick;

a transmitter within the housing; and a processor;

wherein the movement data comprises a direction of movement from the neutral position and occurs over 360 degrees, wherein the direction of movement from the neutral position defines a joystick direction, generating, based on the movement data, a steering command for instructing a trolling motor to aim in a steer direction to directly correspond to the joystick direction, wherein the steer direction is a pointing direction of the trolling motor for directing propulsion of the trolling motor, wherein the steer direction occurs over 360 degrees;

transmitting the steering command to a controller, wherein the controller is communicatively coupled to the trolling motor, and wherein the controller causes the trolling motor to execute the steering command, wherein the steering command causes the trolling motor to rotate so as to aim in the steer direction to cause the watercraft to travel based on movement of the joystick;

continuously generating steering commands based on adjustments in the direction of movement from the neutral position of the joystick; and correspondingly, transmitting the steering commands to the trolling motor to cause the trolling motor to adjust the steer direction to match a corresponding joystick direction for each of the adjustments in the direction of movement from the neutral position of the joystick.

21. The method of claim 20, further comprising:

calibrating the user input device with the trolling motor, such that a forward movement of the joystick corresponds to a forward orientation of the trolling motor, wherein the forward orientation of the trolling motor corresponds with a forward direction of the watercraft.

* * * * *